US012152312B2

(12) United States Patent
Tsuji et al.

(10) Patent No.: US 12,152,312 B2
(45) Date of Patent: Nov. 26, 2024

(54) PLATING APPARATUS AND AIR BUBBLE REMOVING METHOD OF PLATING APPARATUS

(71) Applicant: EBARA CORPORATION, Tokyo (JP)

(72) Inventors: Kazuhito Tsuji, Tokyo (JP); Masashi Obuchi, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 288 days.

(21) Appl. No.: 17/624,132

(22) PCT Filed: Feb. 25, 2021

(86) PCT No.: PCT/JP2021/007024
§ 371 (c)(1),
(2) Date: Dec. 30, 2021

(87) PCT Pub. No.: WO2022/180727
PCT Pub. Date: Sep. 1, 2022

(65) Prior Publication Data
US 2023/0295829 A1 Sep. 21, 2023

(51) Int. Cl.
*C25D 21/10* (2006.01)
*C25D 17/06* (2006.01)
*C25D 21/04* (2006.01)

(52) U.S. Cl.
CPC ..... *C25D 21/10* (2013.01); *C25D 17/06* (2013.01); *C25D 21/04* (2013.01)

(58) Field of Classification Search
None
See application file for complete search history.

(56) References Cited

U.S. PATENT DOCUMENTS 6,004,440 A 12/1999 Hanson et al.
6,736,945 B2 * 5/2004 Ishida ..... C25D 17/06 204/278
(Continued)

FOREIGN PATENT DOCUMENTS

CN 1674231 A 9/2005
JP H11-209890 A 8/1999
(Continued)

*Primary Examiner* — Louis J Rufo
(74) *Attorney, Agent, or Firm* — BakerHostetler

(57) ABSTRACT

Provided is a technique that ensures the suppressed deterioration of plating quality of a substrate due to air bubbles that remain on a surface to be plated of the substrate.

A plating apparatus 1000 includes a plating tank 10, a substrate holder 30, a rotation mechanism 40, and an elevating mechanism 50. The plating tank 10 is configured to accumulate a plating solution and include an anode 11 arranged inside the plating tank. The substrate holder 30 is arranged above the anode and configured to hold a substrate as a cathode such that a surface to be plated of the substrate faces downward. The substrate holder includes a ring 31 projecting below an outer peripheral edge of the surface to be plated of the substrate. The rotation mechanism 40 is configured to rotate the substrate holder. The elevating mechanism 50 is configured to elevate the substrate holder. The ring has a lower surface, and at least one protrusion 35 projecting toward a lower side is arranged on a part of the lower surface.

6 Claims, 15 Drawing Sheets

(56) References Cited

U.S. PATENT DOCUMENTS

| | | | | |
|---|---|---|---|---|
| RE45,687 | E | 9/2015 | Saito et al. | |
| 2002/0127790 | A1 | 9/2002 | Hongo et al. | |
| 2004/0079646 | A1 | 4/2004 | Hirao | |
| 2005/0000817 | A1* | 1/2005 | McHugh | C25D 17/10 205/89 |
| 2008/0210562 | A1* | 9/2008 | Kawakami | C25D 17/008 204/225 |
| 2012/0000786 | A1* | 1/2012 | Mayer | C25D 17/02 204/275.1 |
| 2022/0205126 | A1* | 6/2022 | Tsai | C25D 17/001 |

FOREIGN PATENT DOCUMENTS

| | | | |
|---|---|---|---|
| JP | 2002-294495 | A | 10/2002 |
| JP | 2003-027280 | A | 1/2003 |
| JP | 2003-510456 | A | 3/2003 |
| JP | 2008-013851 | A | 1/2008 |
| JP | 2008-019496 | A | 1/2008 |
| JP | 2008-208421 | A | 9/2008 |
| JP | 2009-293088 | A | 12/2009 |
| KR | 2005-0056263 | A | 6/2005 |
| KR | 2014-0130645 | A | 11/2014 |
| KR | 10-1788678 | B1 | 10/2017 |
| TW | I254085 | B | 5/2006 |
| WO | WO 2004/038072 | A2 | 5/2004 |

* cited by examiner

PLATING APPARATUS AND AIR BUBBLE REMOVING METHOD OF PLATING APPARATUS

TECHNICAL FIELD

The present invention relates to a plating apparatus and an air bubble removing method of the plating apparatus.

BACKGROUND ART

Conventionally, there has been known what is called a cup type plating apparatus as a plating apparatus that performs a plating process on a substrate (for example, see PTL 1). Such a plating apparatus includes a plating tank that accumulates a plating solution and has an anode arranged in its inside, a substrate holder that is arranged above the anode and holds a substrate as a cathode such that a surface to be plated of the substrate faces downward, a rotation mechanism that rotates the substrate holder, and an elevating mechanism that elevates the substrate holder. Further, the substrate holder of such a plating apparatus has a ring projecting below an outer peripheral edge of a surface to be plated of the substrate.

CITATION LIST

Patent Literature

PTL 1: Japanese Unexamined Patent Application Publication No. 2008-19496

SUMMARY OF INVENTION

Technical Problem

In the cup type plating apparatus as described above, for some reason, air bubbles are generated in the plating solution in the plating tank in some cases. In this case, the air bubbles possibly remain on the surface to be plated of the substrate. In particular, in a case where the ring as described above is disposed in the substrate holder, it is not easy for the air bubbles in the plating solution to get over the ring, thus raising the possibility of the air bubbles remaining on the surface to be plated of the substrate. Thus, in a case where the air bubbles remain on the surface to be plated of the substrate, plating quality of the substrate possibly deteriorates due to the air bubbles that remain.

The present invention has been made in view of the above, and one of the objects of the present invention is to provide a technique that ensures the suppressed deterioration of plating quality of a substrate due to air bubbles that remain on a surface to be plated of the substrate.

Solution to Problem

[Aspect 1] To achieve the above-described object, a plating apparatus according to one aspect of the present invention includes a plating tank, a substrate holder, a rotation mechanism, and an elevating mechanism. The plating tank is configured to accumulate a plating solution and include an anode arranged inside the plating tank. The substrate holder is arranged above the anode and configured to hold a substrate as a cathode such that a surface to be plated of the substrate faces downward. The substrate holder includes a ring projecting below an outer peripheral edge of the surface to be plated of the substrate. The rotation mechanism is configured to rotate the substrate holder. The elevating mechanism is configured to elevate the substrate holder. The ring has a lower surface, and at least one protrusion projecting toward a lower side is arranged on a part of the lower surface.

With this aspect, the substrate holder rotates in a state where the surface to be plated of the substrate is immersed in the plating solution. Thus, the plating solution can be pushed out in a rotation direction of the substrate holder by the protrusion, and this allows for generating a strong flow (liquid flow) of the plating solution heading from a center side of the surface to be plated of the substrate to an outer peripheral side. This strong liquid flow allows for causing air bubbles that exist on the surface to be plated of the substrate to get over the ring and to be discharged to an outside of the ring. That is, the air bubbles that exist on the surface to be plated of the substrate can be removed from the surface to be plated. This can suppress deterioration of plating quality of the substrate due to the air bubbles that remain on the surface to be plated of the substrate.

[Aspect 2] In Aspect 1 described above, the protrusion may include a plate having an axis line extending from an inner peripheral side toward an outer peripheral side on a lower surface of the ring.

[Aspect 3] In Aspect 2 described above, assuming that an angle formed by an axis line of the protrusion and a tangent line of an inner circumference surface of the ring is measured from the axis line side toward the tangent line side in a rotation direction of the substrate holder when the substrate holder rotates in one direction, when the angle is 0° or more and less than 20°, the rotation mechanism may rotate the substrate holder at 100 rpm or more. When the angle is 20° or more and less than 60°, the rotation mechanism may rotate the substrate holder at 40 rpm or more. When the angle is 600 or more and 1200 or less, the rotation mechanism may rotate the substrate holder at 25 rpm or more. When the angle is more than 1200 and 1600 or less, the rotation mechanism may rotate the substrate holder at 25 rpm or more. When the angle is more than 160° and 180° or less, the rotation mechanism may rotate the substrate holder at 100 rpm or more.

[Aspect 4] In Aspect 3 described above, the angle may be 60° or more and 160° or less.

[Aspect 5] In Aspect 4 described above, the rotation mechanism may rotate the substrate holder at 30 rpm or more.

[Aspect 6] In any one aspect of the above-described aspects 1 to 5, a plurality of the protrusions may be provided. With this aspect, compared with a case where the number of the protrusion is one, the air bubbles that exist on the surface to be plated of the substrate can be effectively removed.

[Aspect 7] Aspect 3 described above may be configured as follows. A plurality of the protrusions are provided, the plurality of protrusions include a first protrusion and a second protrusion, the first protrusion having the angle of 60° or more and 160° or less when measured from the axis line side toward the tangent line side in a rotation direction of the substrate holder in a case where the substrate holder normally rotates, the second protrusion having the angle of 60° or more and 1600 or less when measured from the axis line side toward the tangent line side in a rotation direction of the substrate holder in a case where the substrate holder reversely rotates, and the rotation mechanism may be configured to perform normally rotating and reversely rotating the substrate holder, each at least once, at a time of a plating process performing a plating process on the surface to be plated of the substrate.

With this aspect, in a case where the substrate holder rotates at the time of the plating process (in a case of normally rotating and reversely rotating), any one of the first protrusion and the second protrusion has an "angle formed by the axis line of the protrusion and the tangent line of the inner circumference surface of the ring, which is an angle when measured from the axis line side toward the tangent line side in the rotation direction of the substrate holder" of 60° or more and 1600 or less.

[Aspect 8] Any one aspect of the above-described aspects 1 to 7 may be configured as follows. The plating apparatus further includes at least one supply port and at least one discharge port. The at least one supply port is disposed in an outer peripheral wall of the plating tank and configured to supply a plating solution to the plating tank. The at least one discharge port is disposed in the outer peripheral wall of the plating tank so as to face the supply port, the at least one discharge port being configured to suction a plating solution in the plating tank and to discharge the plating solution from the plating tank. The supply port and the discharge port may be configured to form a shear flow of the plating solution along the surface to be plated below the surface to be plated of the substrate in the plating tank, by suctioning the plating solution supplied from the supply port by the discharge port.

With this aspect, in a case where the surface to be plated of the substrate is immersed in the plating solution, the air bubbles generated at the center of the surface to be plated of the substrate can be easily moved toward the outer peripheral side of the surface to be plated by the shear flow. This allows for effectively discharging the air bubbles that have moved to the outer peripheral side to the outside of the ring by the protrusion.

[Aspect 9] Any one aspect of the above-described aspects 1 to 7 may be configured as follows. The plating apparatus further includes a flow mechanism configured to flow a plating solution in the plating tank such that a liquid surface of the plating solution at a center of the plating tank rises upward before the surface to be plated of the substrate is immersed in the plating solution. The elevating mechanism may be configured to cause a center of the surface to be plated of the substrate to come in contact with a plating solution earlier than an outer peripheral edge of the surface to be plated by moving down the substrate holder in a state where the liquid surface of the plating solution at a center of the plating tank rises upward.

With this aspect, when the surface to be plated of the substrate comes in contact with the plating solution, the center of the surface to be plated is brought into contact first. Accordingly, the surface to be plated can be immersed in the plating solution while the air bubbles that exist at the center of the surface to be plated are released to the outer peripheral side of the surface to be plated. Consequently, this allows for effectively discharging the air bubbles that have moved to the outer peripheral side to the outside of the ring by the protrusion.

[Aspect 10] In any one aspect of the above-described aspects 1 to 7, the plating apparatus may be configured to cause the surface to be plated of the substrate to come in contact with a plating solution in a state of being inclined with respect to a horizontal liquid surface of the plating solution in the plating tank.

With this aspect, when the surface to be plated of the substrate comes in contact with the plating solution, the surface to be plated can be immersed in the plating solution while the air bubbles that exist on the surface to be plated are moved obliquely upward along the surface to be plated by utilizing buoyancy. This allows for effectively moving the air bubbles to the outer peripheral side of the surface to be plated. Consequently, this allows for effectively discharging the air bubbles that have moved to the outer peripheral side to the outside of the ring by the protrusion.

[Aspect 11] Any one aspect of the above-described aspects 1 to 7 may be configured as follows. The plating apparatus further includes a paddle configured to stir a plating solution in the plating tank by being arranged above the anode in the plating tank and below the substrate and by reciprocating in a horizontal direction.

With this aspect, by stirring the plating solution by the paddle, the air bubbles that exist on the surface to be plated of the substrate can be effectively moved to the outer peripheral side of the surface to be plated. This allows for effectively discharging the air bubbles that have moved to the outer peripheral side to the outside of the ring by the protrusion.

[Aspect 12] To achieve the above-described object, an air bubble removing method of a plating apparatus according to one aspect of the present invention is provided. The plating apparatus includes a plating tank and a substrate holder. The plating tank is configured to accumulate a plating solution and include an anode arranged inside the plating tank. The substrate holder is arranged above the anode and configured to hold a substrate as a cathode such that a surface to be plated of the substrate faces downward. The substrate holder includes a ring projecting below an outer peripheral edge of the surface to be plated of the substrate. The ring has a lower surface, and at least one protrusion projecting toward a lower side is arranged on a part of the lower surface. The air bubble removing method includes rotating the substrate holder in a state where the surface to be plated of the substrate is immersed in a plating solution.

With this aspect, the deterioration of the plating quality of the substrate due to the air bubbles that remain on the surface to be plated of the substrate can be suppressed.

DESCRIPTION OF EMBODIMENTS

[Embodiment] The following will describe an embodiment of the present invention with reference to the drawings. Note that, in the following embodiment and modifications of the embodiment described later, identical reference signs are assigned for identical or corresponding configurations, and their descriptions may be appropriately omitted. Further, the drawings are schematically illustrated to facilitate understanding of the features of constituent elements, and dimensional proportions and the like of each constituent element are not necessarily the same as the actual ones. Further, in some drawings, orthogonal coordinates of X-Y-Z are illustrated for reference. Of the orthogonal coordinates, the Z direction corresponds to an upper side, and the −Z direction corresponds to a lower side (direction in which gravity acts).

Figure 1:
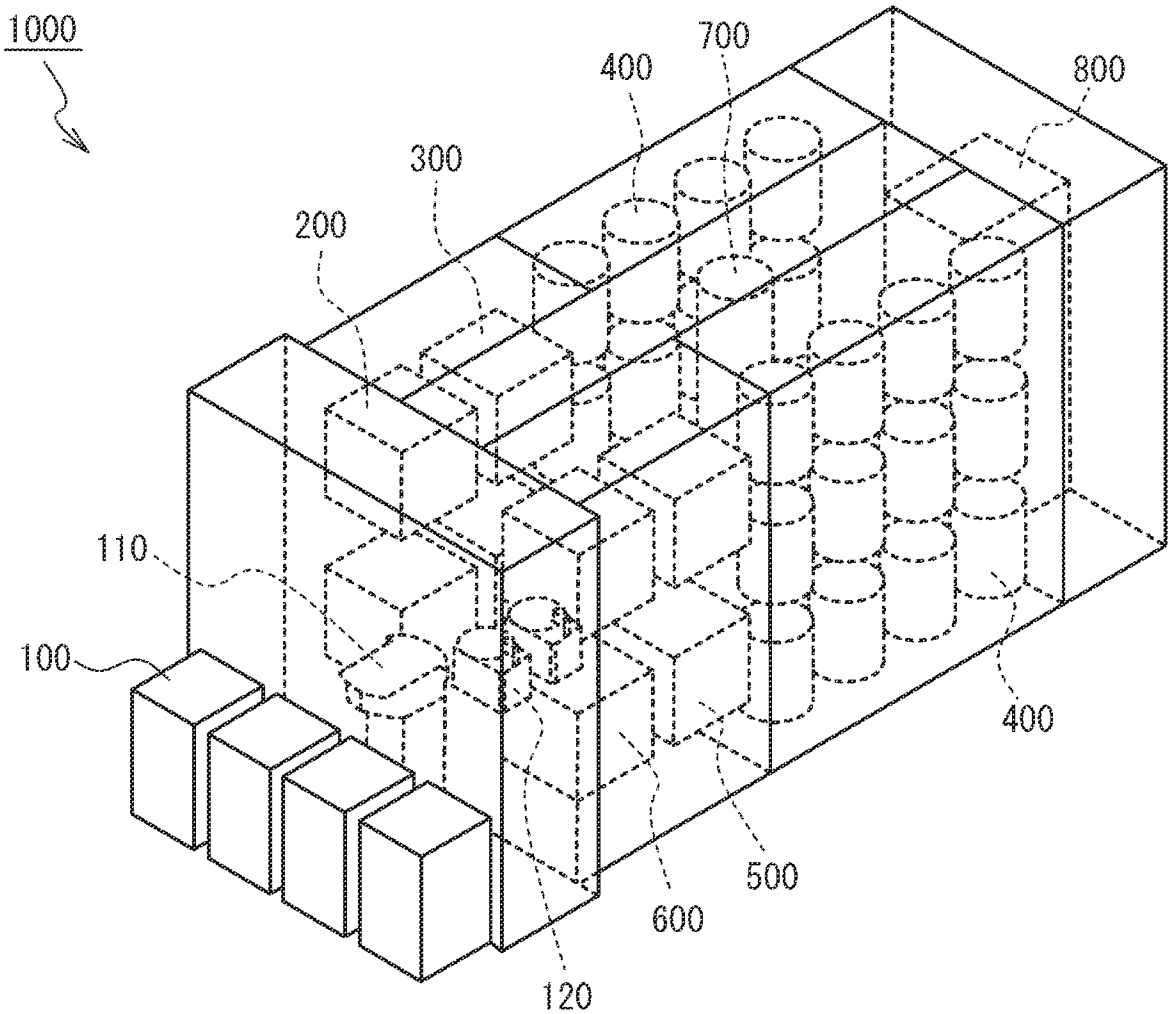
FIG. 1 is a perspective view illustrating an overall configuration of a plating apparatus of this embodiment.
Figure 2:
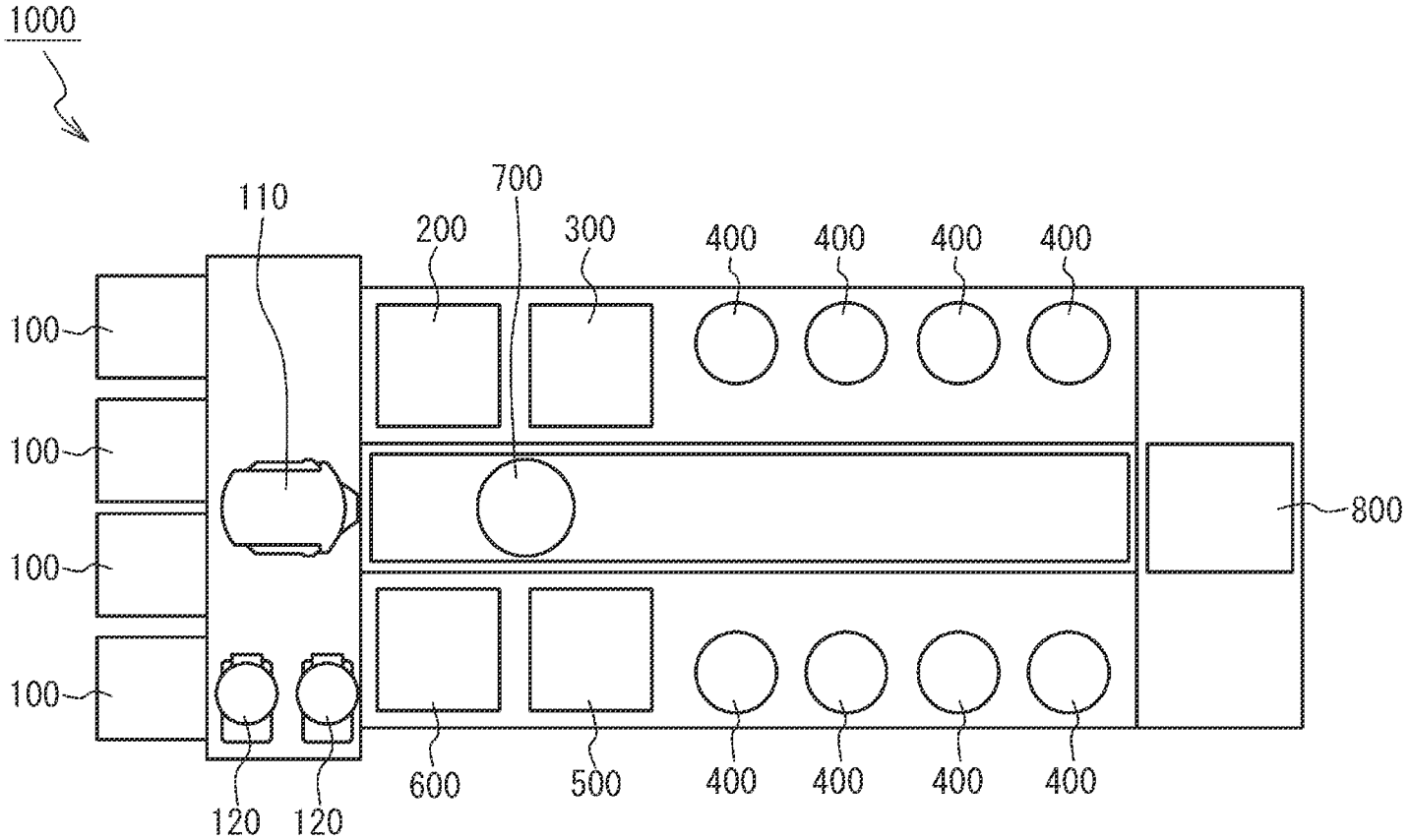
FIG. 2 is a plan view illustrating the overall configuration of the plating apparatus of this embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 70).

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating modules 400 will be described. Since the plurality of plating modules 400 included in the plating apparatus 1000 according to this embodiment have the identical configuration, one of the plating modules 400 will be described.

Figure 3:
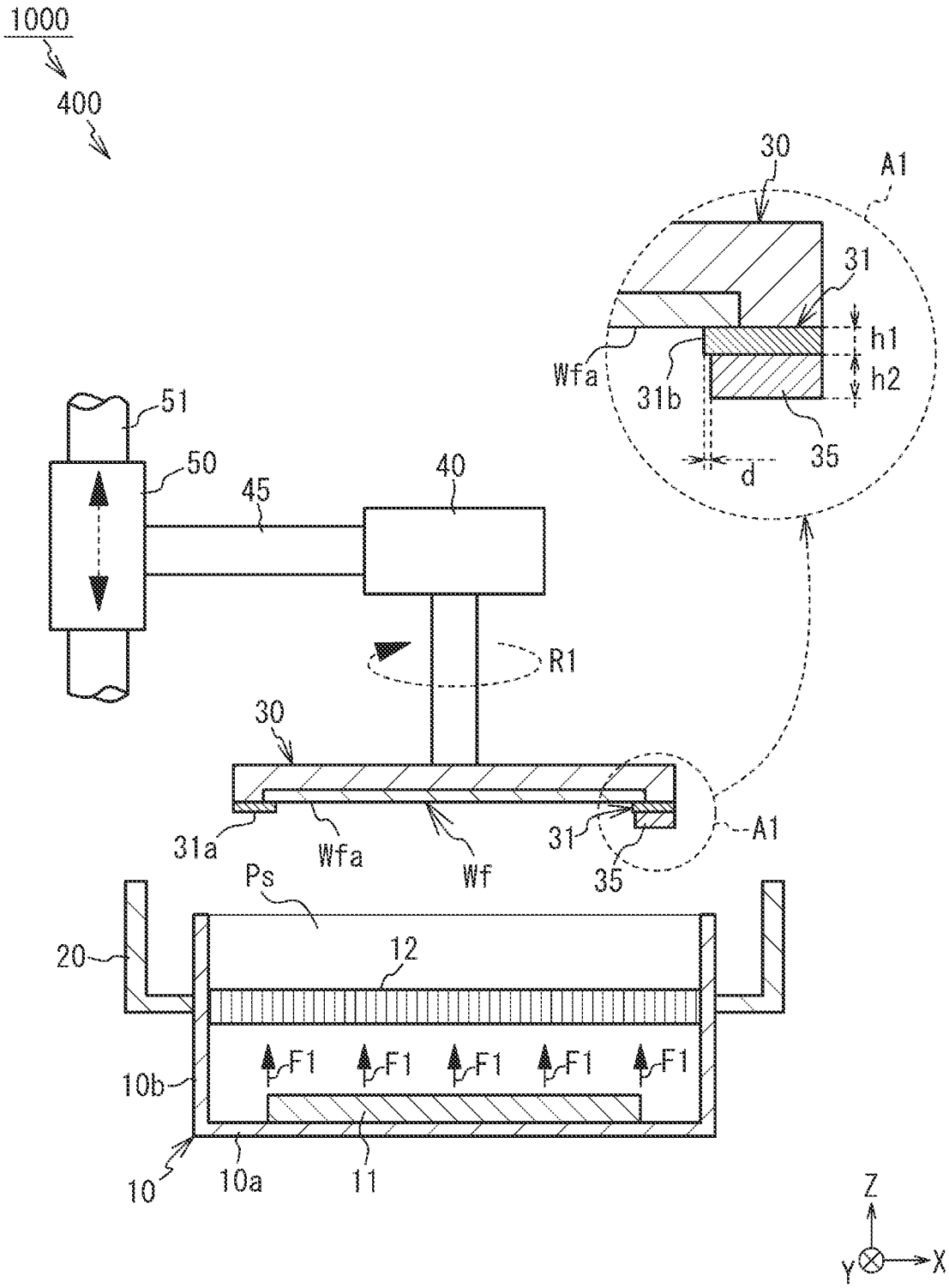
FIG. 3 is a schematic diagram illustrating a configuration of a plating module in the plating apparatus of this embodiment.

FIG. 3 is a schematic diagram illustrating the configuration of the plating module 400 in the plating apparatus 1000 of this embodiment. The plating apparatus 1000 according to this embodiment is a cup type plating apparatus. The plating module 400 of the plating apparatus 1000 according to this embodiment includes a plating tank 10, an overflow tank 20, a substrate holder 30, a rotation mechanism 40, an inclination mechanism 45, and an elevating mechanism 50. Note that in FIG. 3, for some members (such as the plating tank 10, the overflow tank 20, and the substrate holder 30), their cross sections are schematically illustrated.

The plating tank 10 according to this embodiment is configured of a container with a bottom having an opening on an upper side. Specifically, the plating tank 10 has a bottom wall 10*a* and an outer peripheral wall 10*b* extending upward from an outer peripheral edge of the bottom wall 10*a*, and an upper portion of the outer peripheral wall 10*b* is open. Note that, although the shape of the outer peripheral wall 10*b* of the plating tank 10 is not particularly limited, the outer peripheral wall 10*b* according to this embodiment has a cylindrical shape as an example. In an inside of the plating tank 10, a plating solution Ps is accumulated.

It is only necessary for the plating solution Ps to be a solution including an ion of a metallic element constituting a plating film, and a specific example of the plating solution Ps is not particularly limited. In this embodiment, a copper plating process is used as an example of the plating process, and a copper sulfate solution is used as an example of the plating solution Ps. Further, in this embodiment, a predetermined additive is included in the plating solution Ps. However, the configuration of the plating solution Ps is not limited to this, and the plating solution Ps can be configured not to include an additive.

In the plating tank 10, a plating solution supply port (not illustrated) for supplying the plating solution Ps to the plating tank 10 is disposed. The plating solution supply port according to this embodiment is arranged in the bottom wall 10*a* of the plating tank 10 and supplies the plating solution Ps toward the upper side. Note that "F1" illustrated in FIG. 3 illustrates an example of a flow direction of the plating solution Ps supplied from the plating solution supply port.

In the inside of the plating tank 10, an anode 11 is arranged. Specifically, the anode 11 according to this embodiment is arranged on the bottom wall 10*a* of the plating tank 10 as an example. The specific type of the anode 11 is not particularly limited, and the anode 11 may be an insoluble anode or may be a soluble anode. In this embodiment, the insoluble anode is used as an example of the anode 11. The specific type of the insoluble anode is not particularly limited, and platinum, iridium oxide, and the like can be used. Note that a substrate Wf and the anode 11 are electrically connected to an energization device (not illustrated). The energization device is a device for flowing electricity between the substrate Wf and the anode 11 when the plating process is performed.

In the inside of the plating tank 10, an ionically resistive element 12 is arranged above the anode 11. Specifically, the ionically resistive element 12 is configured of a porous plate member having a plurality of holes (pores). The ionically resistive element 12 is a member disposed for ensuring homogenization of an electric field formed between the anode 11 and the substrate Wf. Thus, by arranging the ionically resistive element 12 in the plating tank 10, homogenization of a film thickness of the plating film (plated layer) formed on the substrate Wf can be easily ensured. Note that the ionically resistive element 12 is not a required member in this embodiment, and the plating apparatus 1000 may be configured not to include the ionically resistive element 12.

The overflow tank 20 is configured of a container with a bottom arranged outside the plating tank 10. The overflow tank 20 is disposed for temporarily accumulating the plating solution Ps exceeding an upper end of the outer peripheral wall 10*b* of the plating tank 10 (that is, the plating solution Ps overflowing from the plating tank 10). The plating solution Ps temporarily accumulated in the overflow tank 20 is discharged from a discharge port (not illustrated) for the overflow tank 20, and afterwards, is temporarily accumulated in a reservoir tank (not illustrated) for the overflow tank 20. The plating solution Ps accumulated in the reservoir tank is then pressure fed by a pump (not illustrated) and circulated to the plating tank 10 again from the plating solution supply port.

The substrate holder 30 is arranged above the anode 11 (in this embodiment, further above the ionically resistive element 12). The substrate holder 30 holds the substrate Wf as a cathode such that a surface to be plated Wfa of the substrate Wf faces downward.

With reference specifically to an enlarged view of an A1 part of FIG. 3, the substrate holder 30 according to this embodiment has a ring 31 (ring-shaped member) disposed so as to project below an outer peripheral edge of the surface to be plated Wfa of the substrate Wf (see FIG. 5 described later for a lower surface view of the ring 31). Note that "h1" illustrated in the A1 part enlarged view of FIG. 3 indicates a height of the ring 31 (projection height). Further, in this embodiment, although a lower surface 31*a* of the ring 31 is substantially a planar surface (planar surface extending in a horizontal direction), the configuration is not limited to this. For example, the lower surface 31*a* of the ring 31 may be inclined with respect to the horizontal direction.

Although the material of the substrate holder 30 (also including the ring 31) is not particularly limited, polyvinyl chloride (PVC) is used as an example in this embodiment. Note that a sealing member (not illustrated) for suppressing invasion of the plating solution Ps into a gap between the substrate holder 30 and the substrate Wf may be arranged between the substrate holder 30 and the substrate Wf. That is, in this case, the substrate holder 30 holds the substrate Wf via the sealing member. As the material of the sealing member, fluorine-containing rubber (FKM) and the like can be used.

The substrate holder 30 is connected to the rotation mechanism 40. The rotation mechanism 40 is a mechanism for rotating the substrate holder 30. Specifically, the rotation mechanism 40 according to this embodiment is configured to rotate the substrate holder 30 in a normal rotation direction (R1). Note that, in this embodiment, as an example, the normal rotation direction (R1) among the rotation directions of the substrate holder 30 is a clockwise direction in an upper surface view (or a plan view) in which the substrate holder 30 is viewed from the upper side. The specific type of the rotation mechanism 40 is not particularly limited, and for example, a known rotation motor and the like can be used.

The inclination mechanism 45 is a mechanism for inclining the substrate holder 30 with respect to a horizontal surface. Specifically, the inclination mechanism 45 according to this embodiment inclines the substrate holder 30 by inclining the rotation mechanism 40. As the inclination mechanism 45 such as this, for example, a known inclination mechanism, such as a piston and cylinder, can be used. The elevating mechanism 50 is supported by a spindle 51 extending in a vertical direction. The elevating mechanism 50 is a mechanism for elevating the substrate holder 30, the rotation mechanism 40, and the inclination mechanism 45 in the vertical direction. As the elevating mechanism 50, a known elevating mechanism, such as a linear motion type actuator, can be used.

The operation of the plating module 400 is controlled by the control module 800. The control module 800 includes a microcomputer, and the microcomputer includes a CPU (Central Processing Unit) as a processor, a storage device as a non-transitory storage medium, and the like. The control module 800 controls the operation of units to be controlled of the plating module 400 (such as the rotation mechanism 40, the inclination mechanism 45, and the elevating mechanism 50) by an actuation of the CPU as a processor based on a command of a program stored in the storage device.

Figure 4:
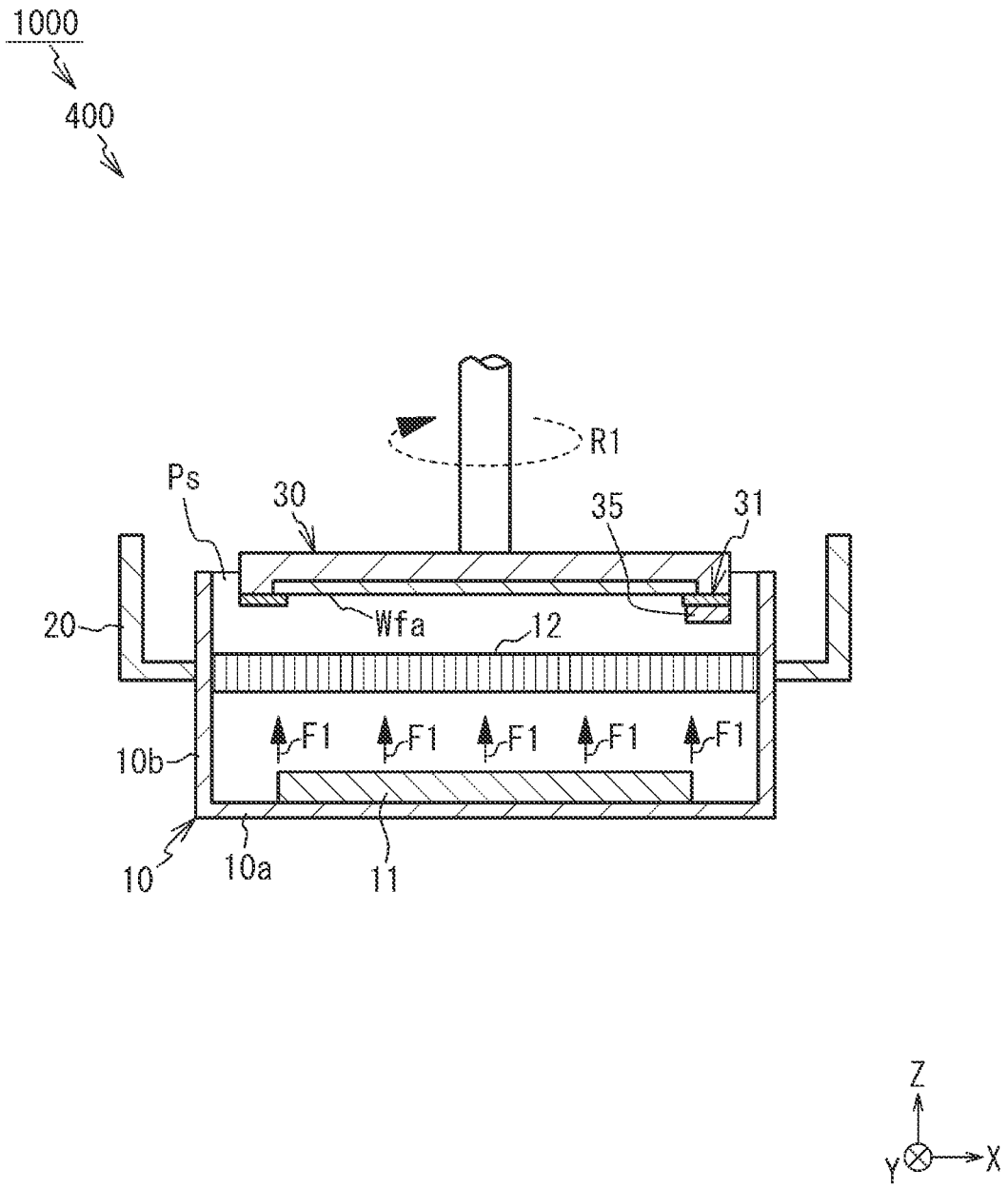
FIG. 4 is a schematic cross-sectional view illustrating a state where a substrate of this embodiment is immersed in a plating solution.

FIG. 4 is a schematic cross-sectional view illustrating a state where the substrate Wf is immersed in the plating solution Ps. At a "time of the plating process" that performs the plating process on the surface to be plated Wfa of the substrate Wf, the rotation mechanism 40 rotates the substrate holder 30 while the elevating mechanism 50 moves the substrate holder 30 downward to immerse the substrate Wf in the plating solution Ps in the plating tank 10. Note that the substrate holder 30 may have rotated since before the surface to be plated Wfa of the substrate Wf comes in contact with the plating solution Ps, or may rotate after the surface to be plated Wfa of the substrate Wf comes in contact with the plating solution Ps. Next, a current flows between the anode 11 and the substrate Wf by the energization device. This forms the plating film on the surface to be plated Wfa of the substrate Wf. Note that, at the time of the plating process, the inclination mechanism 45 may incline the substrate holder 30 as necessary.

Incidentally, in the cup type plating apparatus 1000 as this embodiment, for some reason, air bubbles (Bu: this reference sign is exemplified in FIG. 5 described later) are generated in the plating solution Ps in the plating tank 10 in some cases. Specifically, in a case where the insoluble anode is used as the anode 11 as in this embodiment, oxygen (02) is generated in the plating solution Ps based on the following reaction equation when the plating process is performed (when energizing). In this case, the generated oxygen can become the air bubbles.

$$2H_2O \rightarrow O_2 + 4H^+ + 4e^-$$

Further, provisionally, if the soluble anode is used as the anode 11, the reaction equation as described above does not occur. However, for example, when the plating solution Ps is first introduced into the plating tank 10, air possibly flows in the plating tank 10 together with the plating solution Ps. Accordingly, even in the case where the soluble anode is used as the anode 11, the air bubbles may be generated in the plating solution Ps in the plating tank 10.

As described above, in the case where the air bubbles are generated in the plating solution Ps in the plating tank 10, provisionally, if the air bubbles remain on the surface to be plated Wfa of the substrate Wf, the air bubbles that remain possibly cuts off the electric field. In this case, the plating quality of the substrate Wf possibly deteriorates. Therefore, in this embodiment, in order to deal with this problem, a technique described below is used.

Figure 5:
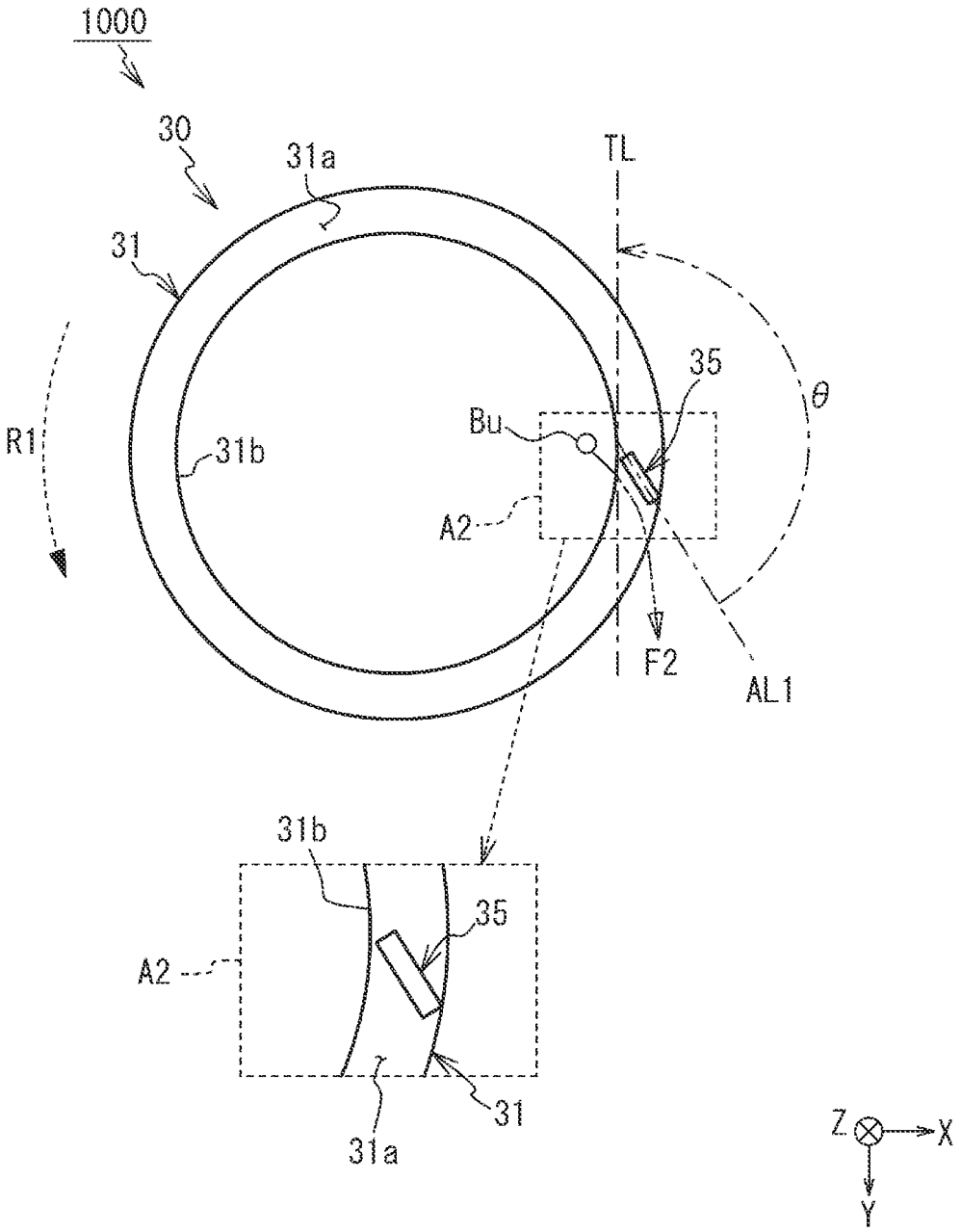
FIG. 5 is a schematic bottom view of a substrate holder of this embodiment.

FIG. 5 is a schematic bottom view illustrating a state in which the substrate holder 30 is viewed from the lower side. With reference to FIG. 5 and specifically to the A1 part enlarged view of FIG. 3 described above, at least one protrusion 35 projecting toward a lower side is arranged on a part of the lower surface 31*a* of the ring 31 according to this embodiment. Although the number of the protrusion 35 may be one or may be plural, the number of the protrusion 35 according to this embodiment is one as an example.

The protrusion 35 is configured to push out the plating solution Ps in the rotation direction of the substrate holder 30 by the protrusion 35 in a case where the rotation mechanism 40 rotates the substrate holder 30 in a state where the surface to be plated Wfa of the substrate Wf is immersed in the plating solution Ps.

Specifically, as illustrated in FIG. 5, the protrusion 35 according to this embodiment is configured of a plate having an axis line AL1 extending from an inner peripheral side toward an outer peripheral side on the lower surface 31*a* of the ring 31. With this configuration, the plating solution Ps can be effectively pushed out in the rotation direction of the substrate holder 30 by the protrusion 35.

Note that, although the specific shape of the protrusion 35 is not particularly limited, as an example, the protrusion 35 according to this embodiment has a rectangular shape with a direction of the axis line AL1 being a longitudinal direction in the lower surface view.

With this embodiment as described above, the substrate holder 30 rotates in the state where the surface to be plated Wfa of the substrate Wf is immersed in the plating solution Ps, whereby the plating solution Ps can be pushed out in the rotation direction of the substrate holder 30 by the protrusion 35, and this allows for generating a strong flow (liquid flow) of the plating solution Ps heading from the center side of the surface to be plated Wfa of the substrate Wf to the outer peripheral side. This strong liquid flow allows for causing the air bubbles (Bu) that exist on the surface to be plated Wfa of the substrate Wf to get over the ring 31 and to be discharged to an outside of the ring 31 (note that "F2" in FIG. 5 is a line illustrating an example of a flow direction of the air bubbles). That is, the air bubbles that exist on the surface to be plated Wfa of the substrate Wf can be removed from the surface to be plated Wfa. This can suppress the deterioration of the plating quality of the substrate Wf due to the air bubbles that remain on the surface to be plated Wfa of the substrate Wf.

[Working example] For the above-described plating apparatus 1000, a removal degree of the air bubbles from the surface to be plated Wfa of the substrate Wf when a "rotational speed of the substrate holder 30" and an "angle θ formed by the axis line AL1 of the protrusion 35 and a tangent line TL of an inner circumference surface 31*b* of the ring 31" was varied was confirmed by an experiment. Note that, specifically, the "angle θ" formed by the axis line AL1 and the tangent line TL is an "angle θ when measured from the axis line AL1 side toward the tangent line TL side in the rotation direction of the substrate holder 30 in a case where the substrate holder 30 rotates in one direction (in a case of normally rotating in this embodiment)". The experimental result will be described below.

The plating apparatus 1000 used in the experiment was the plating apparatus 1000 exemplified in from FIG. 3 to FIG. 5, and specifically, the plating apparatus 1000 having the height (h1) of the ring 31 of 2.5 mm, a height (h2) of the protrusion 35 of 5 mm, and a distance (d) in the horizontal direction between the inner circumference surface 31*b* of the ring 31 and the protrusion 35 of 0.5 mm was used. The substrate Wf held by the substrate holder 30 was immersed in the plating solution Ps in the plating tank 10, 0.1 ml of the air bubbles was remained on the surface to be plated Wfa of the substrate Wf, and next, the substrate holder 30 was rotated in the normal rotation direction by the rotation mechanism 40 at the rotational speeds (revolutions per minute: rpm) described in Table 1. The removal degree of the air bubbles from the surface to be plated Wfa of the substrate Wf at this time was visually measured.

The measurement results are shown in Table 1. Note that, although the rotational speeds of the substrate holder 30 shown in Table 1 are in a range from a low speed (10 rpm) to a high speed (100 rpm), this is a range of the rotational speed assumed during ordinary use of the plating apparatus 1000. Further, in a case where the rotational speed of the substrate holder 30 was more than 100 rpm, a similar result to a case where the rotational speed was 100 rpm was obtained. Accordingly, presentation of the measurement results in the case where the rotational speed was more than 100 rpm are omitted.

lower surface 31*a* of the ring 31 of the substrate holder 30 and rotating the substrate holder 30, the air bubbles that exist on the surface to be plated Wfa of the substrate Wf can be removed from the surface to be plated Wfa.

However, the evaluation of "C" or higher is more preferable than the evaluation of "D" in the respect that an air bubble removal effect is high. Combinations of an "angle θ and rotational speed" with which the evaluation of "C" or higher can be obtained are as follows.

That is, in a case where the angle θ is 0° or more and less than 20°, the substrate holder 30 preferably rotates at 100 rpm or more in the respect that the evaluation of "C" or higher can be obtained. Similarly, in a case where the angle θ is 200 or more and less than 60° the substrate holder 30 preferably rotates at 40 rpm or more. In a case where the angle θ is 60° or more and 120° or less, the substrate holder 30 preferably rotates at 25 rpm or more. In a case where the angle θ is more than 120° and 160° or less, the substrate holder 30 preferably rotates at 25 rpm or more. In a case where the angle θ is more than 160° and 1800 or less, the substrate holder 30 preferably rotates at 100 rpm or more.

Further, from Table 1, it can be seen that the range of the rotational speed of the substrate holder 30 at which the evaluation of "C" or higher can be obtained becomes wider in a case where the angle θ is in a range of 60° or more and 160° or less, compared with a case where the angle θ is less than 60° or a case where the angle θ is more than 160°. That is, in the case where the angle θ is in the range of 60° or more and 1600 or less, a high air bubble removal effect can be

TABLE 1

| | | ANGLE(θ) | | | | |
|---|---|---|---|---|---|---|
| | | 0° ≤ θ < 20° | 20° ≤ θ < 60° | 60° ≤ θ ≤ 120° | 120° < θ ≤ 160° | 160° < θ ≤ 180° |
| ROTATIONAL SPEED (rpm) | 10 | D | D | D | D | D |
| | 20 | D | D | D | D | D |
| | 25 | D | D | C | C | D |
| | 30 | D | D | B | A | D |
| | 40 | D | B | B | A | D |
| | 50 | D | B | B | A | D |
| | 60 | D | B | B | A | D |
| | 70 | D | B | A | A | D |
| | 100 | C | B | A | A | C |

In Table 1, the removal degree of the air bubbles from the surface to be plated Wfa of the substrate Wf becomes higher in the order from D, C, B, to A. In other words, a time period needed to remove the air bubbles from the surface to be plated Wfa of the substrate Wf becomes shorter in the order from D, C, B, to A. Note that "A" is an air bubble removal degree in which the air bubbles can be surely discharged to the outside of the ring 31 in a case where the air bubbles that exist in an inside with respect to the inner circumference surface 31*b* of the ring 31 come to a position of the protrusion 35. With "B", the time period needed to discharge the air bubbles that exist in the inside of the ring 31 to the outside of the ring 31 is longer than with "A". With "C", this time period is longer than with "B", and with "D", this time period is longer than with "C".

From Table 1, it can be seen that, even in any case where the angle θ is within a range of 0° or more and 1800 or less, evaluations of at least "D" or higher were obtained in the range (in the range from the low speed to the high speed) of the rotational speed of the substrate holder 30 assumed during the ordinary use of the plating apparatus 1000. That is, it can be seen that, by providing the protrusion 35 on the obtained at a wide range of the rotational speed of the substrate holder 30, compared with the case where the angle θ is less than 600 or the case where the angle θ is more than 160°.

Further, from Table 1, it can be seen that, in the range of the angle θ being 600 or more and 160° or less, the range of the rotational speed of the substrate holder 30 at which the evaluation of "A" can be obtained becomes wider in a case where the angle θ is more than 120° and 160° or less, compared with a case where the angle θ is 60° or more and 120° or less. That is, in the case where the angle θ is more than 1200 and 1600 or less, the highest air bubble removal effect can be obtained at a wide range of the rotational speed of the substrate holder 30.

Note that the angle θ of the protrusion 35 in FIG. 5 described above is in the range of 60° or more and 1600 or less, and specifically, in the range of more than 1200 and 1600 or less.

Further, from Table 1, it can be seen that, in the case where the angle θ is in the range of 600 or more and 160° or less, the air bubble removal effect is higher in a case where the rotational speed of the substrate holder 30 is 30 rpm or more, compared with a case of less than 30 rpm. That is, in the case where the angle θ is in the range of 60° or more and 1600 or less, the rotational speed of the substrate holder 30 is preferably 30 rpm or more.

Note that an air bubble removing method of the plating apparatus according to this embodiment is achieved by the above-described plating apparatus 1000. Accordingly, in order to eliminate overlapping description, detailed description of this air bubble removing method is omitted.

Figure 6A:
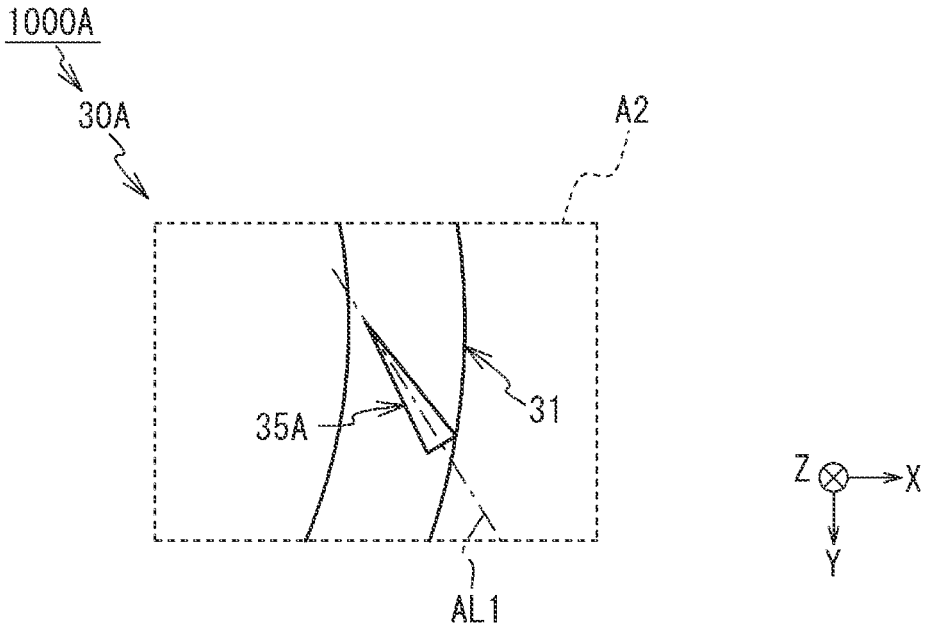
FIG. 6A is a schematic bottom view of a proximity part of a protrusion of a substrate holder of a plating apparatus according to Modification 1 of this embodiment.

[Modification 1 of Embodiment] In the above-described embodiment, although the protrusion 35 has a rectangular shape in the lower surface view, the shape of the protrusion 35 is not limited to this. FIG. 6A is a schematic bottom view of a proximity part (A2 part) of a protrusion 35A of a substrate holder 30A of a plating apparatus 1000A according to Modification 1 of this embodiment. The protrusion 35A according to this modification has a triangular shape in the lower surface view. Specifically, the protrusion 35A according to this modification has an apex in a direction on the inner peripheral side of the ring 31 in the axis line AL1 direction and has a triangular shape in which a width increases as heading from the apex toward a direction on the outer peripheral side of the ring 31. Even in this modification, an operational advantage similar to the embodiment described above can be provided.

Figure 6B:
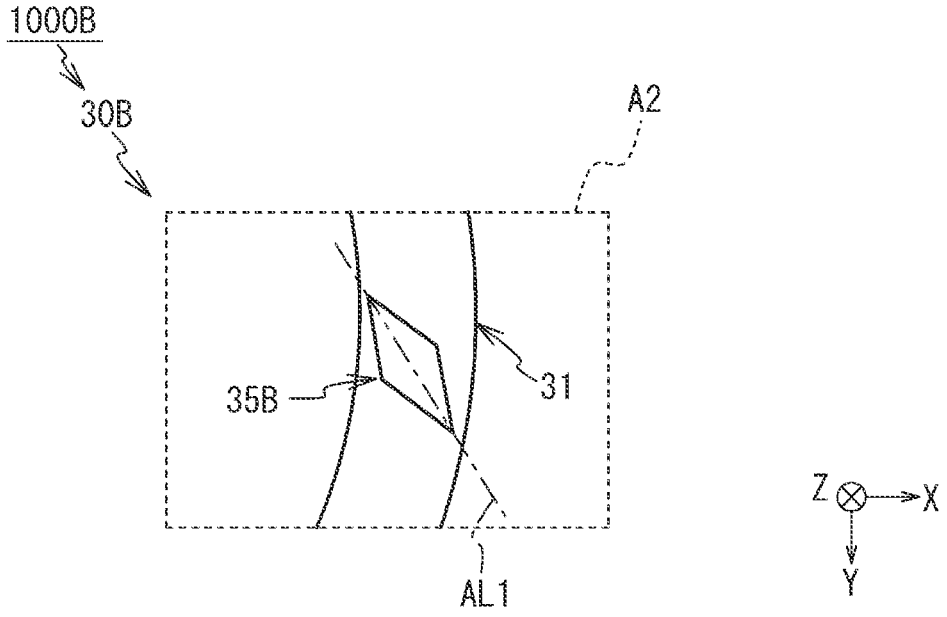
FIG. 6B is a schematic bottom view of a proximity part of a protrusion of a substrate holder of a plating apparatus according to Modification 2 of this embodiment.

[Modification 2 of Embodiment] FIG. 6B is a schematic bottom view of the proximity part (A2 part) of a protrusion 35B of a substrate holder 30B of a plating apparatus 1000B according to Modification 2 of this embodiment. The protrusion 35B according to this modification has a diamond (or parallelogram) shape in the lower surface view.

Specifically, the protrusion 35B according to this modification has a diamond (or parallelogram) shape in which a length in the axis line AL1 direction is longer than a length in a direction perpendicular to the axis line AL1. Even in this modification, the operational advantage similar to the embodiment described above can be provided.

Note that FIG. 6A and FIG. 6B are merely examples of other shapes of the protrusion 35, and the other shapes of the protrusion 35 are not limited to these.

Figure 7:
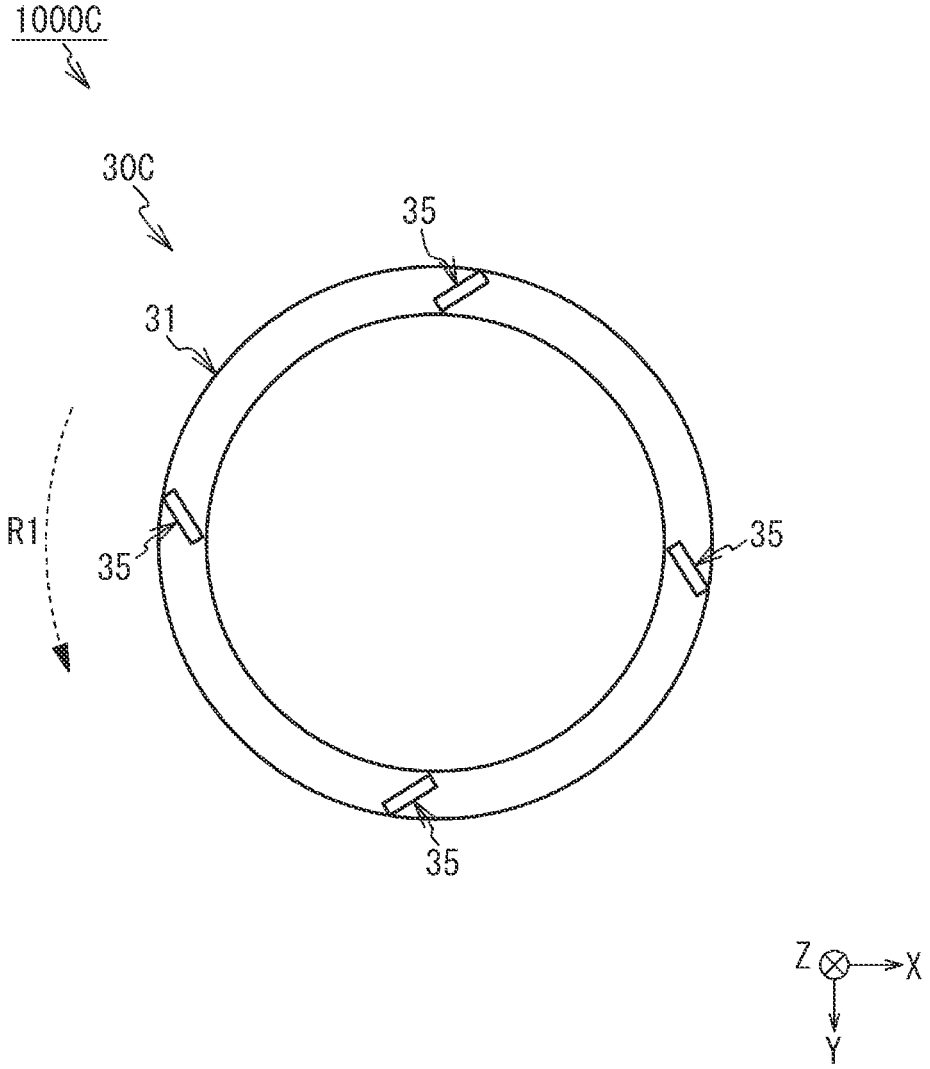
FIG. 7 is a schematic bottom view of a substrate holder of a plating apparatus according to Modification 3 of this embodiment.

[Modification 3 of Embodiment] FIG. 7 is a schematic bottom view of a substrate holder 30C of a plating apparatus 1000C according to Modification 3 of this embodiment. Note that FIG. 7 schematically illustrates a position similar to FIG. 5 described above. The substrate holder 30C according to this modification is different from the substrate holder 30 in FIG. 5 described above in the respect of having a plurality of protrusions 35.

Specifically, four of the plurality of protrusions 35 according to this modification are arranged at regular intervals on the lower surface 31*a* of the ring 31. More specifically, the plurality of protrusions 35 are arranged at intervals of 45° in a circumferential direction of the lower surface 31*a* of the ring 31. Further, in this modification, similarly to the case of FIG. 5, the angle θ of each of the protrusions 35 is in the range of 60° or more and 1600 or less, and specifically, in the range of more than 1200 and 1600 or less.

Note that the number of the plurality of protrusions 35 is not limited to four as described above and may be less than or more than four. Further, the shape of each of the protrusions 35 is not limited to the rectangular as exemplified in FIG. 7 and may be a shape other than the rectangular (for example, the shapes as exemplified in Modification 1 and Modification 2).

With this modification, since the number of the protrusions 35 is plural, compared with a case where the number of the protrusion 35 is one, a frequency in which the air bubbles that exist on the surface to be plated Wfa of the substrate Wf is aligned with the protrusions 35 can be increased. This allows for effectively discharging the air bubbles that exist on the surface to be plated Wfa to the outside of the ring 31 and effectively removing the air bubbles.

Figure 8:
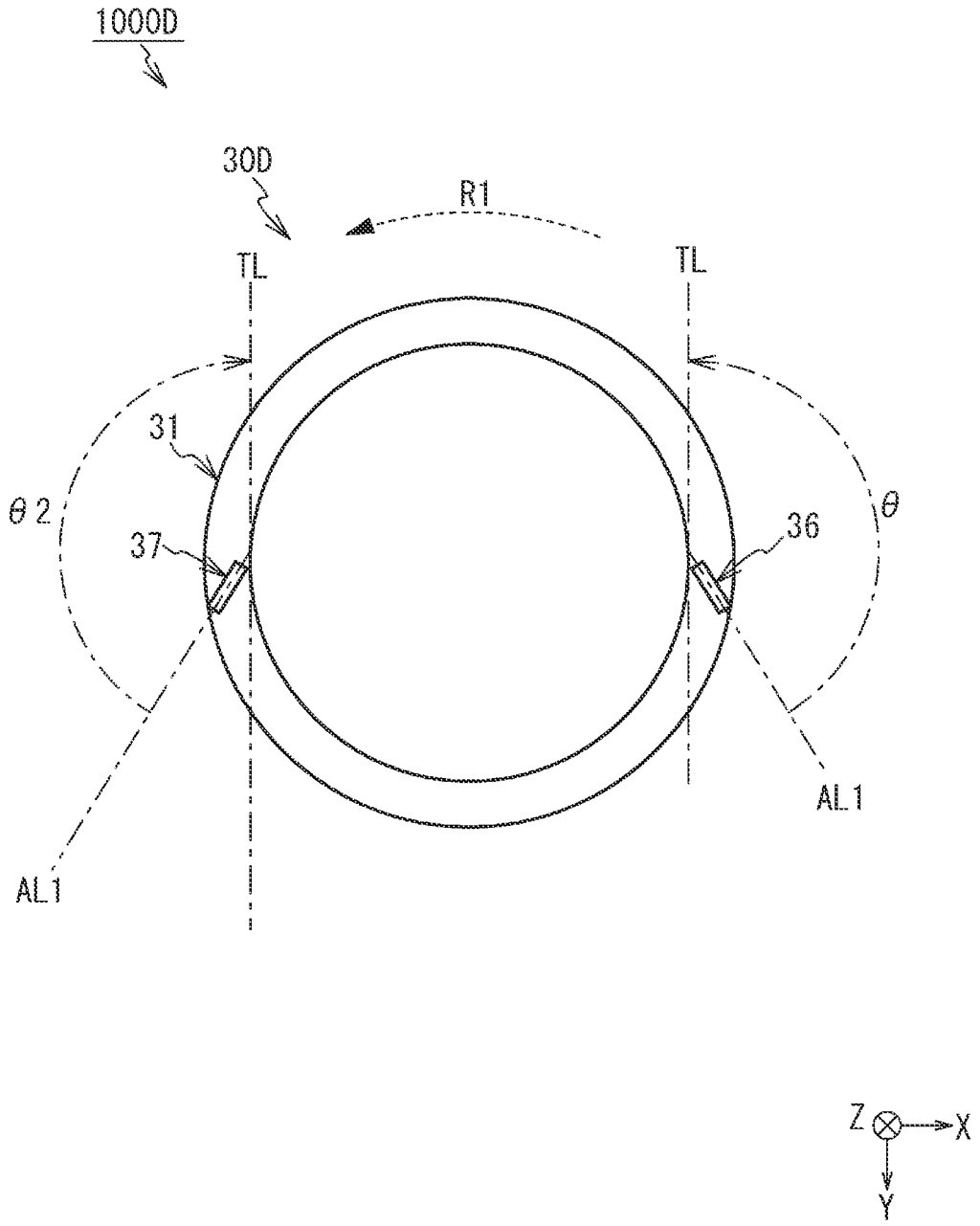
FIG. 8 is a schematic bottom view of a substrate holder of a plating apparatus according to Modification 4 of this embodiment.

[Modification 4 of Embodiment] FIG. 8 is a schematic bottom view of a substrate holder 30D of a plating apparatus 1000D according to Modification 4 of this embodiment. The substrate holder 30D according to this modification is different from the substrate holder 30 in FIG. 5 in the respect of having a first protrusion 36 and a second protrusion 37 as a plurality of protrusions.

The first protrusion 36 has a configuration similar to the protrusion 35 in FIG. 5 described above. That is, the first protrusion 36 is a protrusion configured such that the "angle θ formed by the axis line AL1 and the tangent line TL that is the angle when measured from the axis line AL1 side toward the tangent line TL side in the rotation direction of the substrate holder 30D in a case where the substrate holder 30D normally rotates" becomes 600 or more and 160° or less. Specifically, the "angle θ" of the first protrusion 36 according to this modification is in the range of more than 1200 and 160° or less.

On the other hand, the second protrusion 37 is a protrusion configured such that an "angle θ2 formed by the axis line AL1 and the tangent line TL that is the angle when measured from the axis line AL1 side toward the tangent line TL side in the rotation direction of the substrate holder 30D in a case where the substrate holder 30D reversely rotates" becomes 600 or more and 160° or less. Specifically, the "angle θ2" of the second protrusion 37 according to this modification is in the range of more than 120° and 160' or less.

The rotation mechanism 40 according to this modification performs normally rotating (R1) and reversely rotating (−R1) the substrate holder 30D, each at least once, at the time of the plating process. Specifically, at the time of the plating process, the rotation mechanism 40 may reversely rotate the substrate holder 30D after normally rotating the substrate holder 30D for a predetermined time, may normally rotate the substrate holder 30D after reversely rotating the substrate holder 30D for a predetermined time, or may repeat the normal rotation and reverse rotation (or the reverse rotation and normal rotation) of the substrate holder 30D multiple times.

According to this modification, in a case where the substrate holder 30D rotates (in a case of normally rotating and reversely rotating) at the time of the plating process, any one of the first protrusion 36 and the second protrusion 37 has the "angle formed by the axis line AL1 and the tangent line TL that is the angle when measured from the axis line AL1 side toward the tangent line TL side in the rotation direction of the substrate holder 30D" of 60° or more and 160° or less. Specifically, in the case where the substrate holder 30D normally rotates at the time of the plating process, the "angle θ" of the first protrusion 36 becomes 60° or more and 160° or less. On the other hand, in the case where the substrate holder 30D reversely rotates, the "angle θ2" of the second protrusion 37 becomes 60° or more and 160° or less. With this, in the case where the substrate holder 30D rotates at the time of the plating process, a high air bubble removal effect can be obtained in a wider range of the rotational speed of the substrate holder 30D, compared with a case where the angle of the protrusion arranged on the ring 31 does not become 60° or more and 160° or less (that is, a case where the angle of the protrusion is less than 600 or more than 160°).

Figure 9:
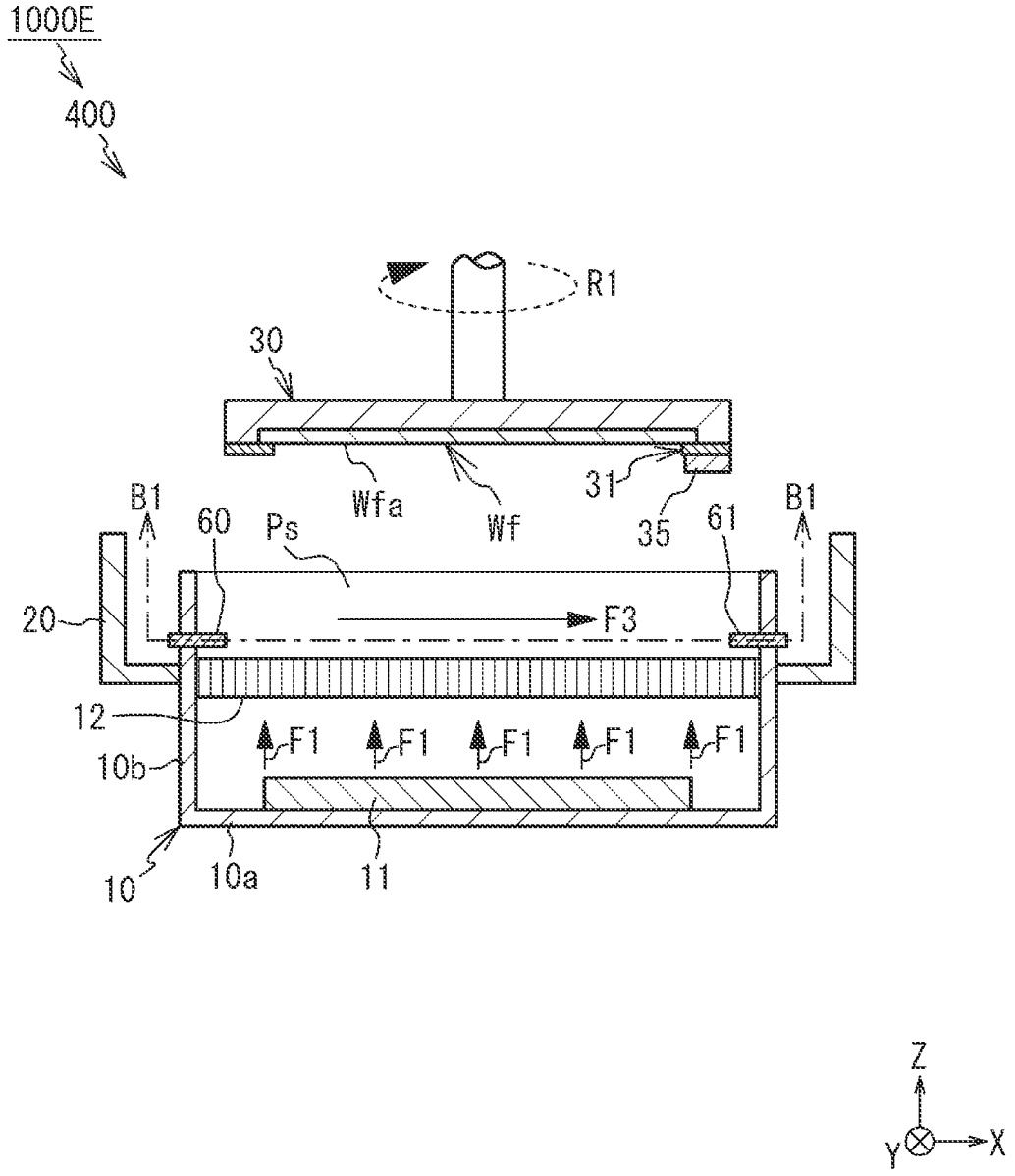
FIG. 9 is a schematic cross-sectional view of a peripheral configuration of a plating tank of a plating apparatus according to Modification 5 of this embodiment.
Figure 10:
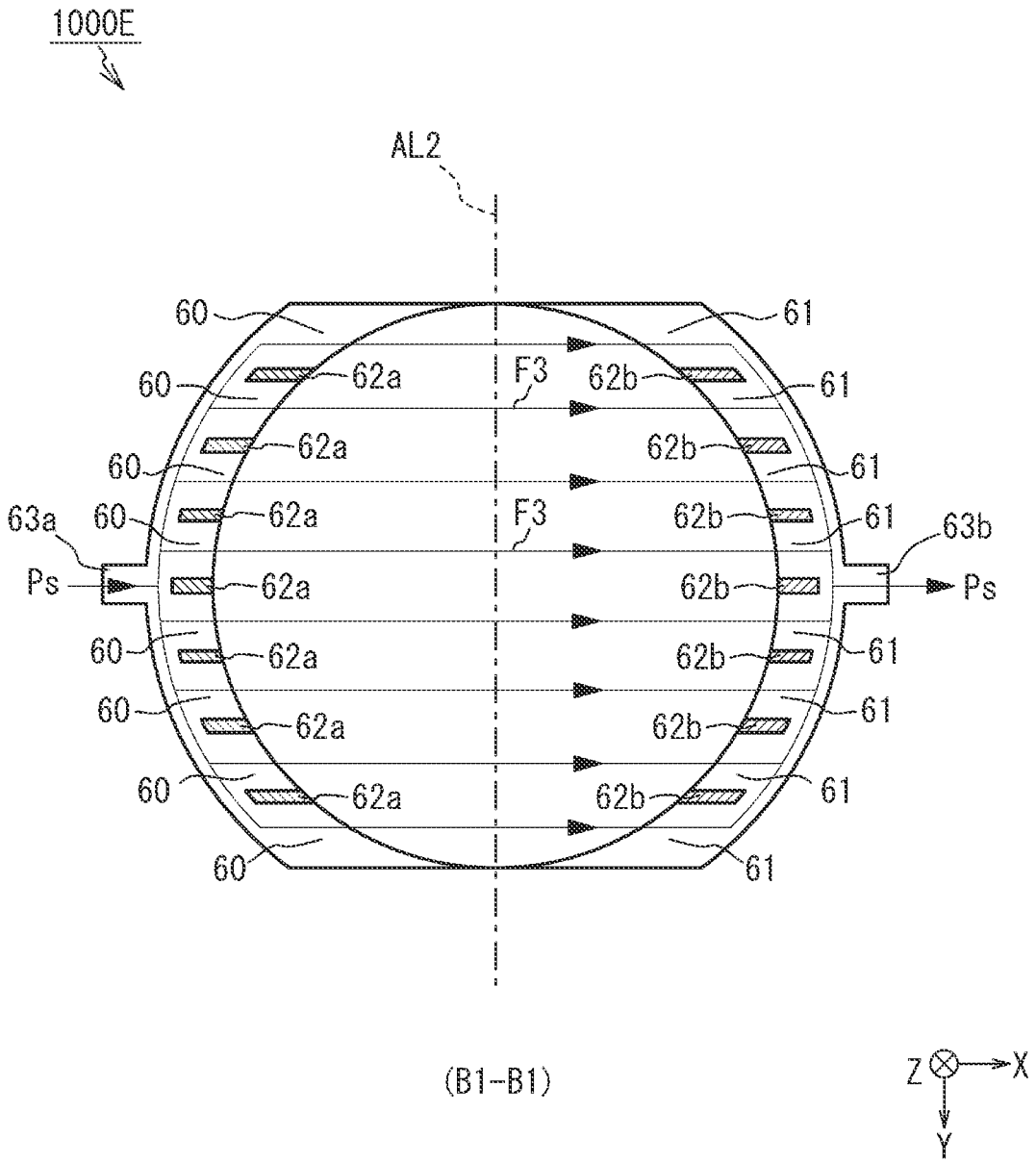
FIG. 10 is a schematic diagram of a cross section taken along line B1-B1 of FIG. 9.

[Modification 5 of Embodiment] FIG. 9 is a schematic cross-sectional view of a peripheral configuration of the plating tank 10 of a plating apparatus 1000E according to Modification 5 of this embodiment. FIG. 10 is a view schematically illustrating a cross section taken along line B1-B1 of FIG. 9. The plating apparatus 1000E according to this modification is different from the plating apparatus 1000 (FIG. 3) according to the embodiment described above in the respect of further including at least one supply port 60 and at least one discharge port 61. Specifically, the plating apparatus 1000E according to this modification includes a plurality of supply ports 60 and a plurality of discharge ports 61.

The supply ports 60 are disposed in the outer peripheral wall 10*b* of the plating tank 10 and configured to supply the plating solution Ps to the plating tank 10. The discharge ports 61 are disposed in the outer peripheral wall 10*b* of the plating tank 10 so as to face the supply ports 60. Further, the discharge ports 61 are configured to suction the plating solution Ps in the plating tank 10 and discharge the plating solution Ps from the plating tank 10. By suctioning the plating solution Ps supplied from the supply ports 60 by the discharge ports 61, the supply ports 60 and the discharge ports 61 form a shear flow (F3) of the plating solution Ps along the surface to be plated Wfa on a lower side of the surface to be plated Wfa of the substrate Wf in the plating tank 10.

Specifically, as illustrated in FIG. 9, the supply ports 60 and the discharge ports 61 according to this modification are arranged at a position above the ionically resistive element 12 in the inside of the plating tank 10. As illustrated in FIG. 10, the supply ports 60 according to this modification are arranged over the whole circumference on one side from an axis line AL2 (line illustrating the central axis) of the outer peripheral wall 10*b* of the plating tank 10. Further, the discharge ports 61 are arranged over the whole circumference on the other side from the axis line AL2 of the outer peripheral wall 10*b* of the plating tank 10. In other words, the supply ports 60 are arranged over a half circumference portion in the outer peripheral wall 10*b* and the discharge ports 61 are arranged over the other half circumference portion in the outer peripheral wall 10*b*.

Note that, in this modification, partition walls 62*a* are disposed between the adjacent supply ports 60, and partition walls 62*b* are disposed also between the adjacent discharge ports 61. Further, portions on an upstream side of the plurality of supply ports 60 are joined together, and the joined portion is referred to as a joint port 63*a*. Further, portions on a downstream side of the plurality of discharge ports 61 are joined together, and the joined portion is referred to as a joint port 63*b*. However, configurations of the supply ports 60 and the discharge ports 61 are not limited to these. For example, a configuration in which the plurality of supply ports 60 are not joined together on the upstream side can be applied, or a configuration in which the plurality of discharge ports 61 are not joined together on the downstream side can be applied.

Further, the numbers of the supply port 60 and the discharge port 61 are not limited to be plural as long as the numbers allows for forming the shear flow (F3). For example, the plating apparatus 1000E may be configured to include only one each of the supply port 60 and the discharge port 61. In this case, in FIG. 10, for example, it is only necessary to be configured not to include the partition walls 62*a* or the partition walls 62*b*. That is, in this case, in FIG. 10, the adjacent supply ports 60 are connected to become one large supply port by having no partition walls 62*a*. Similarly, the adjacent discharge ports 61 are connected to become one large discharge port by having no partition walls 62*b*.

Note that, for a supply start timing of the plating solution Ps from the supply port 60 and a suction start timing of the plating solution Ps from the discharge port 61, it is only necessary to be started at least at a starting time point of the plating process, and the specific timings are not particularly limited. For example, the supply and suction of the plating solution Ps may be started before the substrate Wf comes in contact with the plating solution Ps, or the supply and suction of the plating solution Ps may be started after the substrate Wf is immersed in the plating solution Ps and until the plating process is started.

With this modification, in a case where the surface to be plated Wfa of the substrate Wf is immersed in the plating solution Ps, the air bubbles generated at the center of the surface to be plated Wfa of the substrate Wf can be easily moved toward the outer peripheral side of the surface to be plated Wfa by the shear flow (F3). This allows for effectively discharging the air bubbles that have moved to the outer peripheral side to the outside of the ring 31 by the protrusion 35.

Note that this modification may further include any of the features of Modifications 1 to 4 described above.

Figure 11:
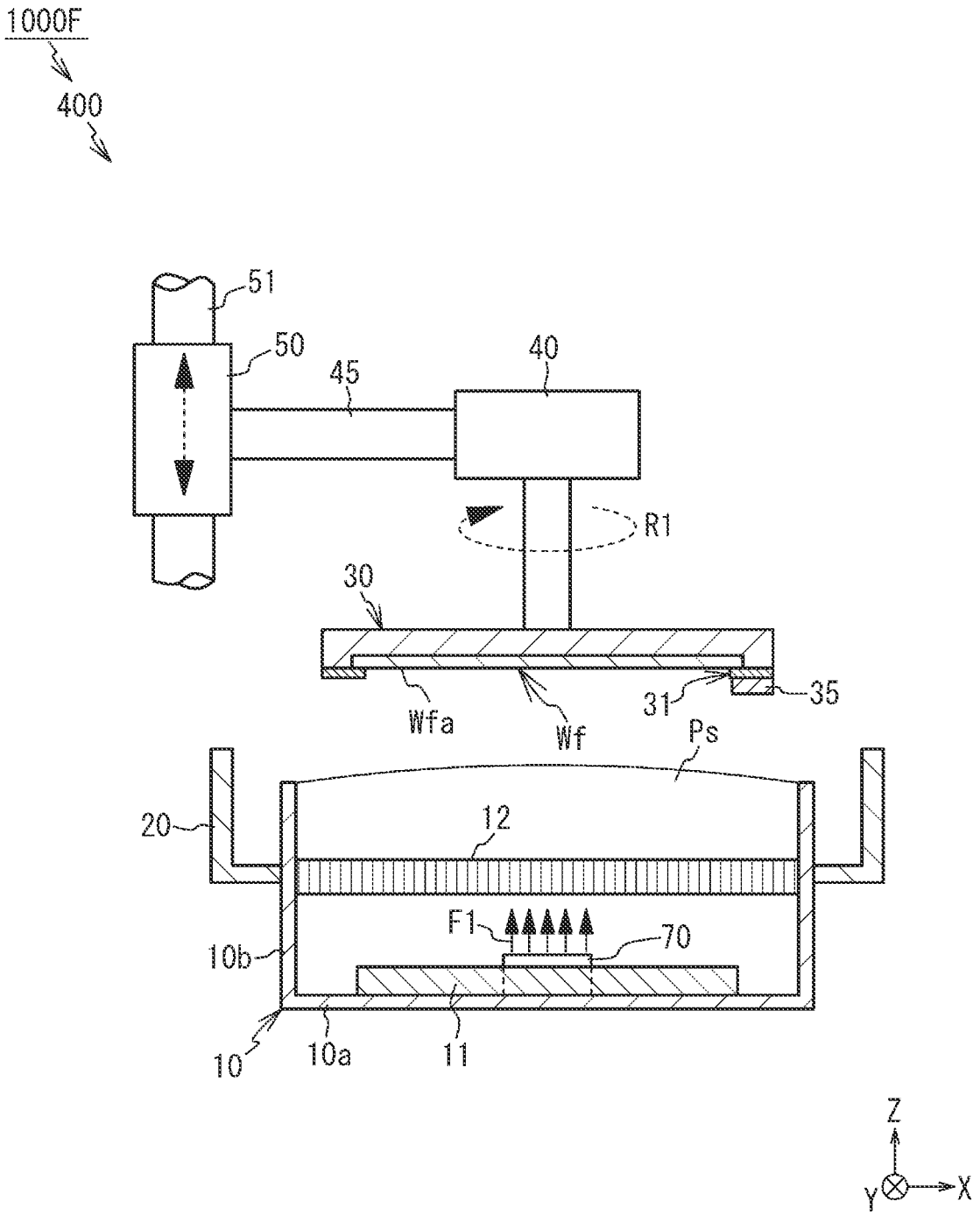
FIG. 11 is a schematic diagram for describing a plating apparatus according to Modification 6 of this embodiment.

[Modification 6 of Embodiment] FIG. 11 is a schematic diagram for describing a plating apparatus 1000F according to Modification 6 of this embodiment. The plating apparatus 1000F according to this modification further includes a flow mechanism 70 configured to flow the plating solution Ps in the plating tank 10 such that a liquid surface of the plating solution Ps at the center of the plating tank 10 rises upward before the surface to be plated Wfa of the substrate Wf is immersed in the plating solution Ps. The configuration other than that is similar to the plating apparatus 1000 according to the embodiment described above.

Specifically, the flow mechanism 70 according to this modification is arranged at the center of the bottom wall 10*a* of the plating tank 10 and configured of a delivery port that delivers the plating solution Ps toward the upper side. By delivering the plating solution Ps toward the upper side by this delivery port, the liquid surface of the plating solution Ps at the center of the plating tank 10 can be easily raised upward.

The elevating mechanism 50 according to this modification moves down the substrate holder 30 in a state where the liquid surface of the plating solution Ps at the center of the plating tank 10 rises upward. This allows the center of the surface to be plated Wfa of the substrate Wf to come in contact with the plating solution Ps earlier than the outer peripheral edge of the surface to be plated Wfa.

Note that, in this modification, the substrate holder 30 may have rotated since before the surface to be plated Wfa of the substrate Wf comes in contact with the plating solution Ps, or may rotate after the surface to be plated Wfa comes in contact with the plating solution Ps.

In this modification, although the ionically resistive element 12 is arranged in the plating tank 10, a configuration in which the ionically resistive element 12 is not arranged in the plating tank 10 can be applied, similarly to the embodiment described above. Note that, in a case where the ionically resistive element 12 is not arranged in the plating tank 10, the liquid surface of the plating solution Ps at the center of the plating tank 10 can be easily raised upward, compared with a case where the ionically resistive element 12 is arranged.

With this modification, when the surface to be plated Wfa of the substrate Wf comes in contact with the plating solution Ps, the center of the surface to be plated Wfa can be brought into contact with the plating solution Ps first. Therefore, the surface to be plated Wfa can be immersed in the plating solution Ps while the air bubbles that exist at the center of the surface to be plated Wfa are released to the outer peripheral side of the surface to be plated Wfa. This allows for effectively discharging the air bubbles that have moved to the outer peripheral side to the outside of the ring 31 by the protrusion 35.

Note that this modification may further include any of the features of Modifications 1 to 4 described above.

Figure 12:
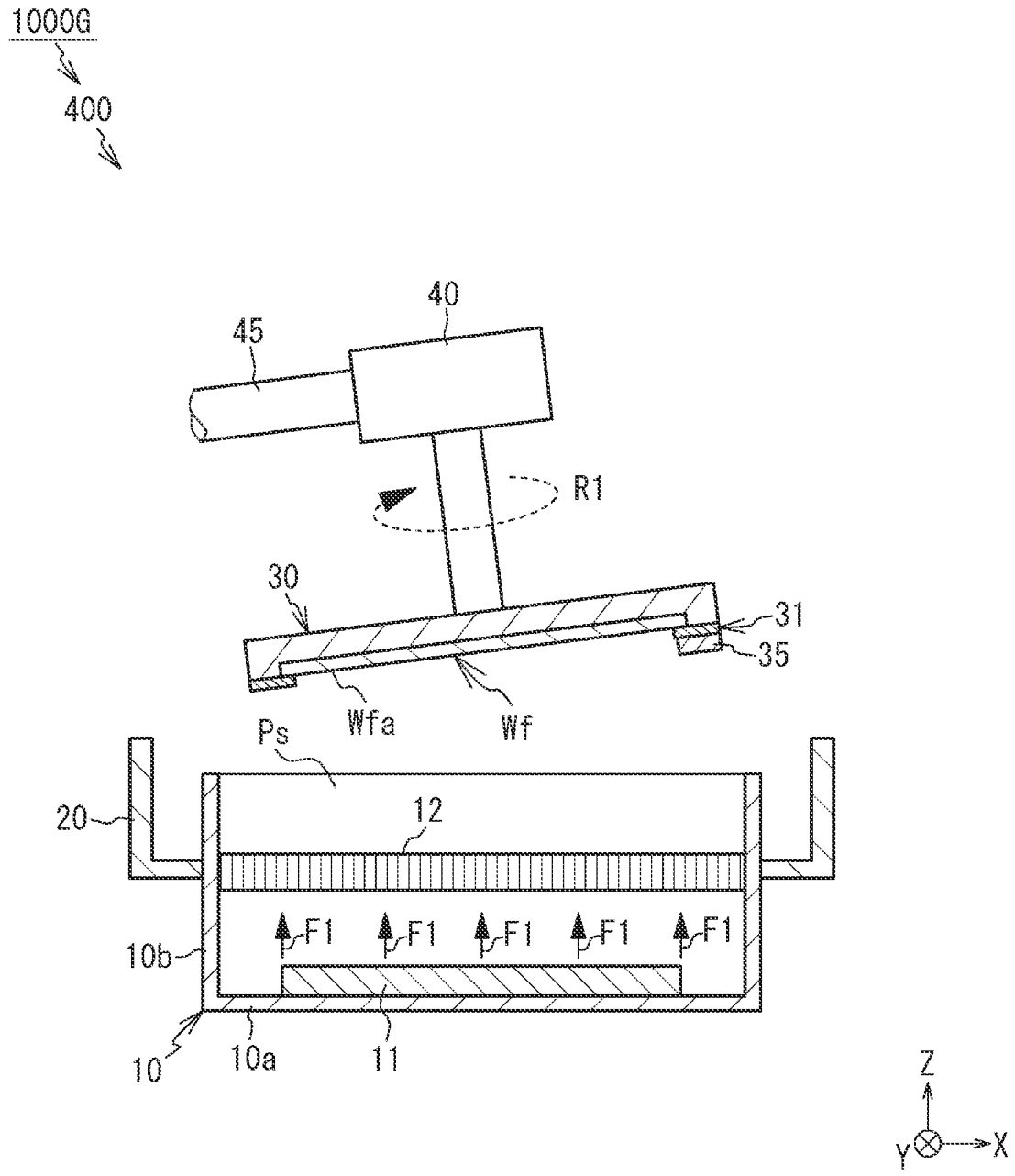
FIG. 12 is a schematic diagram for describing a plating apparatus according to Modification 7 of this embodiment.

[Modification 7 of Embodiment] FIG. 12 is a schematic diagram for describing a plating apparatus 1000G according to Modification 7 of this embodiment. The plating apparatus 1000G according to this modification is different from the plating apparatus 1000 according to the embodiment described above in the respect of being configured such that the surface to be plated Wfa of the substrate Wf comes in contact with the plating solution Ps in a state of being inclined with respect to the horizontal liquid surface of the plating solution Ps in the plating tank 10.

Specifically, the plating apparatus 1000G according to this modification achieves the above-described configuration by the inclination mechanism 45. More specifically, the inclination mechanism 45 of the plating apparatus 1000G inclines the substrate holder 30 with respect to the horizontal surface in a state where the surface to be plated Wfa of the substrate Wf is positioned above the liquid surface of the plating solution Ps. Next, in the state where the substrate holder 30 is inclined in this way, the elevating mechanism 50 moves down the substrate holder 30 to immerse the surface to be plated Wfa of the substrate Wf in the plating solution Ps.

Note that, in this modification, the substrate holder 30 may have rotated since before the surface to be plated Wfa of the substrate Wf comes in contact with the plating solution Ps, or may rotate after the surface to be plated Wfa comes in contact with the plating solution Ps.

With this modification, when the surface to be plated Wfa of the substrate Wf comes in contact with the plating solution Ps, the surface to be plated Wfa can be immersed in the plating solution Ps while the air bubbles that exist on the surface to be plated Wfa are moved obliquely upward along the surface to be plated Wfa by utilizing buoyancy. This allows for effectively moving the air bubbles to the outer peripheral side of the surface to be plated Wfa Consequently, this allows for effectively discharging the air bubbles that have moved to the outer peripheral side to the outside of the ring 31 by the protrusion 35.

Note that this modification may further include any of the features of Modifications 1 to 4 described above.

Figure 13:
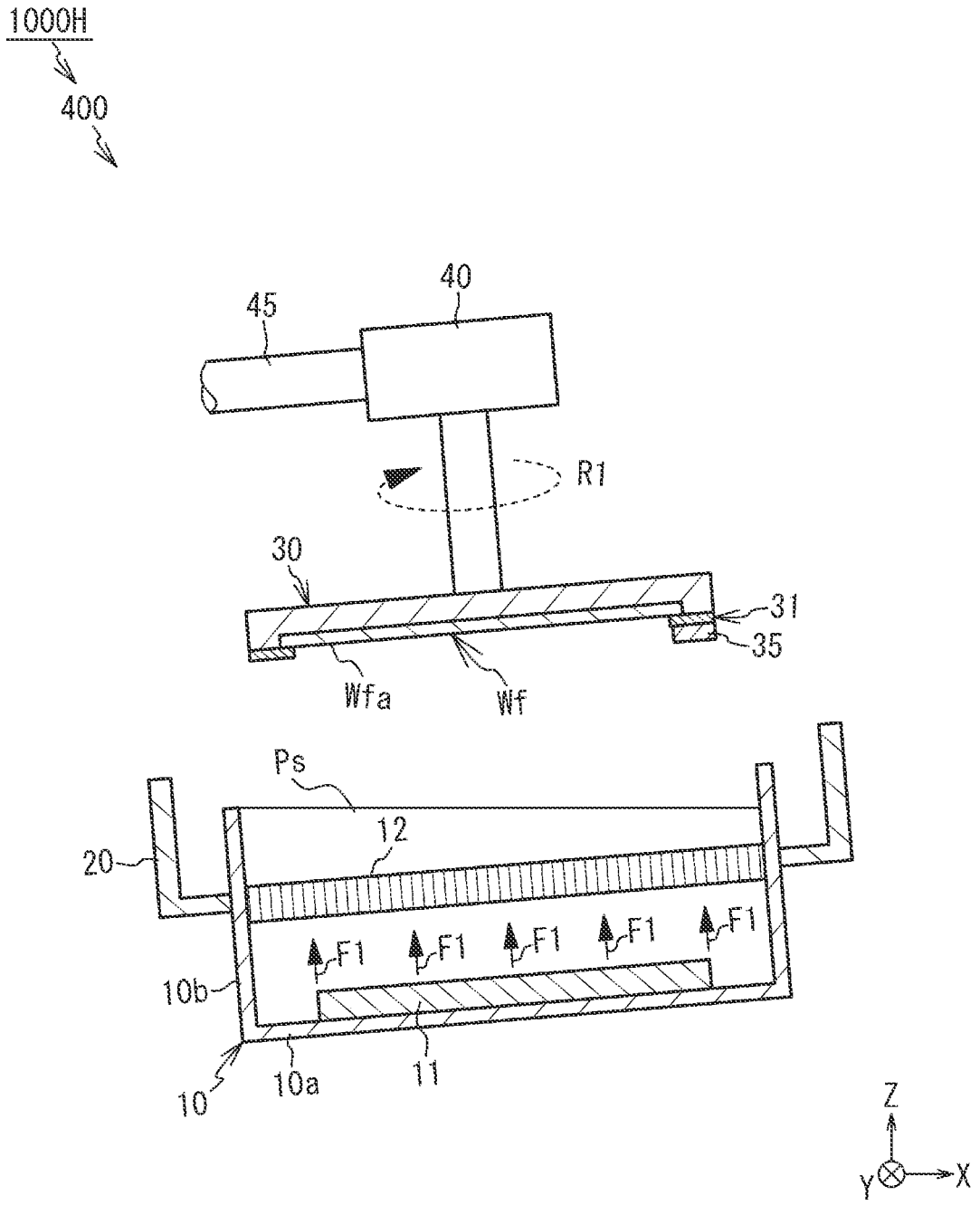
FIG. 13 is a schematic diagram for describing a plating apparatus according to Modification 8 of this embodiment.

[Modification 8 of Embodiment] FIG. 13 is a schematic diagram for describing a plating apparatus 1000H according to Modification 8 of this embodiment. The plating apparatus 1000H according to this modification is configured such that the surface to be plated Wfa of the substrate Wf comes in contact with the plating solution Ps in a state of being inclined with respect to the horizontal liquid surface of the plating solution Ps in the plating tank 10 by having the plating apparatus 1000H installed in a state of being preliminarily inclined with respect to the horizontal surface. That is, at least the substrate holder 30 and the plating tank 10 of the plating apparatus 1000H according to this modification are installed in a state of being preliminarily inclined with respect to the horizontal surface. In this respect, this modification is different from the plating apparatus 1000G according to Modification 7 described above. Note that, in this modification, the plating apparatus 1000H does not have to include the inclination mechanism 45.

Even in this modification, the operational advantage similar to the plating apparatus 1000G according to Modification 7 described above can be provided.

Note that this modification may further include any of the features of Modifications 1 to 4 described above.

Figure 14:
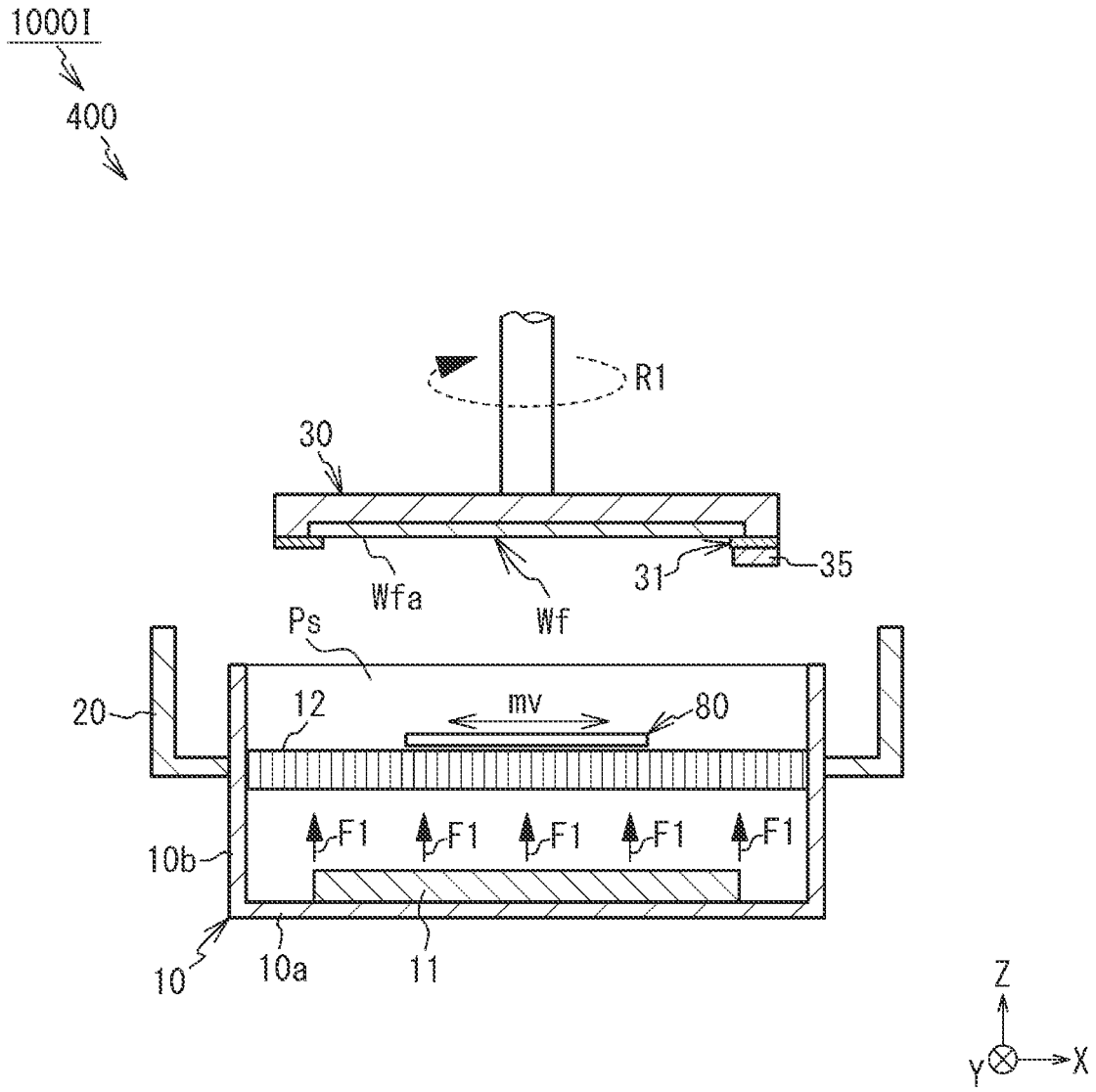
FIG. 14 is a schematic diagram for describing a plating apparatus according to Modification 9 of this embodiment.

[Modification 9 of Embodiment] FIG. 14 is a schematic diagram for describing a plating apparatus 1000I according to Modification 9 of this embodiment. The plating apparatus 1000I according to this modification is different from the plating apparatus 1000 according to the embodiment described above in the respect of further including a paddle 80.

The paddle 80 is arranged above the anode 11 and below the substrate Wf. Specifically, since the ionically resistive element 12 is arranged above the anode 11 in the plating tank 10 according to this modification, the paddle 80 is arranged above the ionically resistive element 12 and below the substrate Wf. The paddle 80 reciprocates in the horizontal direction by being driven by a paddle driving device (not illustrated). This causes the plating solution Ps in the plating tank 10 to be stirred. Note that an illustrated "my" is a reference sign illustrating an example of a movement direction of the paddle 80.

Figure 15:
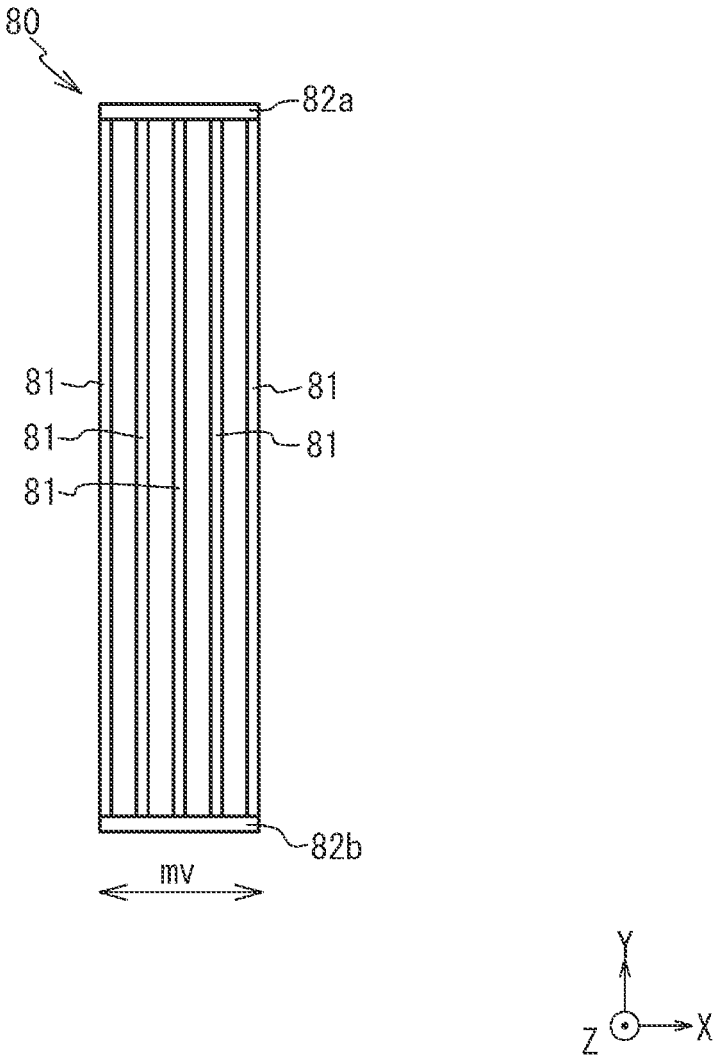
FIG. 15 is a schematic plan view of a paddle according to Modification 9 of this embodiment.

FIG. 15 is a schematic plan view illustrating a state in which the paddle 80 is viewed from the upper side. The paddle 80 according to this modification includes a plurality of stirring members 81 that extend in a direction perpendicular to the reciprocating movement direction of the paddle 80, a coupling member 82*a* that couples end portions on one side in an extending direction of the plurality of stirring members 81, and a coupling member 82*b* that couples end portions on the other side in the extending direction of the plurality of stirring members 81. In a case where the paddle 80 reciprocates, the stirring members 81, in particular, of the paddle 80 stir the plating solution Ps.

Note that, for a start timing of the reciprocating movement of the paddle 80, it is only necessary to start the reciprocating movement at least at the time of the plating process, and the specific timing is not particularly limited. For example, the paddle 80 may have started the reciprocating movement since before the substrate Wf comes in contact with the plating solution Ps. Alternatively, the paddle 80 may start the reciprocating movement after the substrate Wf comes in contact with the plating solution Ps and before the plating process starts (before energization to the substrate Wf starts).

With this modification, by stirring the plating solution Ps by the paddle 80, the air bubbles that exist on the surface to be plated Wfa of the substrate Wf can be effectively moved to the outer peripheral side of the surface to be plated Wfa. This allows for effectively discharging the air bubbles that have moved to the outer peripheral side to the outside of the ring 31 by the protrusion 35.

Note that this modification may further include any of the features of Modifications 1 to 4 described above.

Although the embodiment and modifications according to the present invention have been described in detail above, the present invention is not limited to such specific embodiment and modifications, and further various kinds of variants and modifications are possible within the scope of the gist of the present invention described in the claims.

REFERENCE SIGNS LIST

10 . . . plating tank
11 . . . anode
30 . . . substrate holder
31 . . . ring
31*a* . . . lower surface
31*b* . . . inner circumference surface
35 . . . protrusion
36 . . . first protrusion
37 . . . second protrusion
40 . . . rotation mechanism
45 . . . inclination mechanism
50 . . . elevating mechanism
60 . . . supply port
61 . . . discharge port
70 . . . flow mechanism
80 . . . paddle
1000 . . . plating apparatus
Wf . . . substrate
Wfa . . . surface to be plated
Ps . . . plating solution
Bu . . . air bubble
TL . . . tangent line
AL1 . . . axis line
θ, θ2 . . . angle
F3 . . . shear flow

The invention claimed is:

1. A plating apparatus comprising:

a plating tank configured to accumulate a plating solution and include an anode arranged inside the plating tank;

a substrate holder arranged above the anode and configured to hold a substrate as a cathode such that a surface to be plated of the substrate faces downward, the substrate holder including a ring projecting below an outer peripheral edge of the surface to be plated of the substrate;

a rotation mechanism configured to rotate the substrate holder; and an elevating mechanism configured to elevate the substrate holder, wherein the ring having a lower surface, and a first protrusion and a second protrusion coupled to the lower surface, the first protrusion and the second protrusion each comprising a plate shape and projecting downward from the lower surface, the first protrusion arranged on the lower surface wherein a face of the first protrusion forms an angle between 120° or more and 160° or less when measured from a first axis line extending parallel to the face of the first protrusion to a first line tangent to a circumference of an inner peripheral side of the bottom surface toward an first rotation direction of the substrate holder, the second protrusion arranged at an angle between 120° or more and 160° or less when measured from a second axis line extending parallel to a face of the second protrusion to a second line tangent to the circumference of an inner peripheral side of the bottom surface toward a rotation direction opposite the first rotation direction of the substrate holder, and a control module configured to control the rotation mechanism to cause rotation of the substrate holder at 30 rotations per minute or more in the first direction a least once and in the direction opposite the first direction at least once while performing a plating process on the surface to be plated of the substrate.

2. The plating apparatus according to claim 1, further comprising:

at least one supply port disposed in an outer peripheral wall of the plating tank and configured to supply a plating solution to the plating tank; and at least one discharge port disposed in the outer peripheral wall of the plating tank so as to face the supply port, the at least one discharge port being configured to suction a plating solution in the plating tank and to discharge the plating solution from the plating tank, wherein the supply port and the discharge port are configured to form a shear flow of the plating solution along the surface to be plated below the surface to be plated of the substrate in the plating tank, by suctioning the plating solution supplied from the supply port by the discharge port.

3. The plating apparatus according to claim 1, further comprising a flow mechanism configured to flow a plating solution in the plating tank such that a liquid surface of the plating solution at a center of the plating tank rises upward before the surface to be plated of the substrate is immersed in the plating solution, wherein the elevating mechanism is configured to cause a center of the surface to be plated of the substrate to come in contact with a plating solution earlier than an outer peripheral edge of the surface to be plated by moving down the substrate holder in a state where the liquid surface of the plating solution at the center of the plating tank rises upward.

4. The plating apparatus according to claim 1, wherein the plating apparatus is configured to cause the surface to be plated of the substrate to come in contact with a plating solution in a state of being inclined with respect to a horizontal liquid surface of the plating solution in the plating tank.

5. The plating apparatus according to claim 1, further comprising a paddle configured to stir a plating solution in the plating tank by being arranged above the anode in the plating tank and below the substrate and by reciprocating in a horizontal direction.

6. An air bubble removing method of a plating apparatus, wherein the plating apparatus includes: a plating tank configured to accumulate a plating solution and include an anode arranged inside the plating tank; and a substrate holder arranged above the anode and configured to hold a substrate as a cathode such that a surface to be plated of the substrate faces downward, the substrate holder including a ring projecting below an outer peripheral edge of the surface to be plated of the substrate, the ring has a lower surface, and at least one protrusion projecting toward a lower side is arranged on a part of the lower surface, the protrusion includes a plate having an axis line extending from an inner peripheral side toward an outer peripheral side on a lower surface of the ring, a plurality of the protrusions are provided, the plurality of protrusions include a first protrusion and a second protrusion, the first protrusion having an angle between 120° or more and 160° or less when measured from an axis line side of the protrusions toward a tangent line side of an inner circumference surface of the ring in a rotation direction of the substrate holder in a case where the substrate holder normally rotates, the second protrusion having the angle between 120° or more and 160° or less when measured from the axis line side toward the tangent line side in a rotation direction of the substrate holder in a case where the substrate holder reversely rotates, the air bubble removing method comprises rotating the substrate holder in a state where the surface to be plated of the substrate is immersed in a plating solution; and the rotating the substrate holder comprises normally rotating and reversely rotating the substrate holder at 30 rpm or more, each at least once.

* * * * *